US006291120B1

(12) United States Patent
Nishigaki et al.

(10) Patent No.: US 6,291,120 B1
(45) **Date of Patent: *Sep. 18, 2001**

(54) ELECTROPHOTOGRAPHIC PHOTORECEPTOR AND COATING COMPOSITION FOR CHARGE GENERATING LAYER

(75) Inventors: Satoshi Nishigaki; Takatsugu Obata; Akihiro Kondo, all of Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/568,974

(22) Filed: May 11, 2000

(30) Foreign Application Priority Data

May 14, 1999 (JP) ..... 11-134488
May 19, 1999 (JP) ..... 11-138991

(51) Int. Cl.[7] ..... G03G 5/047
(52) U.S. Cl. ..... 430/58.15; 430/58.75; 430/59.5; 430/970
(58) Field of Search ..... 430/58.15, 58.75, 430/59.5, 75

(56) References Cited

U.S. PATENT DOCUMENTS

| | | |
|---|---|---|
| 3,357,989 | 12/1967 | Byrne et al. . |
| 4,150,987 | 4/1979 | Anderson et al. . |
| 4,214,907 | 7/1980 | Nakazawa et al. . |

(List continued on next page.)

FOREIGN PATENT DOCUMENTS

| | | |
|---|---|---|
| 37 16 975 A1 | 11/1987 | (DE) . |
| 19638 447 A1 | 4/1997 | (DE) . |
| 197 44 029 A1 | 4/1998 | (DE) . |
| 0 658 814 A2 | 6/1995 | (EP) . |
| 0 715 216 A1 | 6/1996 | (EP) . |
| 997 783 * | 5/2000 | (EP) . |
| 1268422 | 3/1972 | (GB) . |
| 49-11136 A | 1/1974 | (JP) . |
| 54-59143 * | 5/1979 | (JP) . |
| 58-32373 B2 | 7/1983 | (JP) . |
| 58-198043 A | 11/1983 | (JP) . |
| 59-49544 A | 3/1984 | (JP) . |
| 59-155851 A | 9/1984 | (JP) . |
| 61-28557 A | 2/1985 | (JP) . |
| 60-86551 A | 5/1985 | (JP) . |
| 61-217050 A | 9/1986 | (JP) . |
| 62-67094 A | 3/1987 | (JP) . |
| 62-133462 A | 6/1987 | (JP) . |
| 63-20365 A | 1/1988 | (JP) . |
| 63-366 A | 1/1988 | (JP) . |
| 63-198067 A | 8/1988 | (JP) . |
| 1-17066 A | 1/1989 | (JP) . |
| 2-8256 A | 1/1990 | (JP) . |
| 3-11353 A | 1/1991 | (JP) . |
| 3-54264 A | 3/1991 | (JP) . |
| 3-54265 A | 3/1991 | (JP) . |
| 3-56966 A | 3/1991 | (JP) . |
| 3-63653 A | 3/1991 | (JP) . |
| 3-87749 A | 4/1991 | (JP) . |
| 5-31137 B2 | 5/1993 | (JP) . |
| 5-55860 B2 | 8/1993 | (JP) . |
| 6-1386 B2 | 1/1994 | (JP) . |
| 6-29975 B2 | 4/1994 | (JP) . |
| 6-39575 B2 | 5/1994 | (JP) . |
| 6-202366 A | 7/1994 | (JP) . |
| 6-301224 A | 10/1994 | (JP) . |
| 7-5851 B2 | 1/1995 | (JP) . |
| 7-30267 B2 | 4/1995 | (JP) . |
| 7-244388 A | 9/1995 | (JP) . |
| 7-261415 A | 10/1995 | (JP) . |
| 7-91486 B2 | 10/1995 | (JP) . |
| 2502404 B2 | 3/1996 | (JP) . |
| 8-209023 A | 8/1996 | (JP) . |
| 9-127711 A | 5/1997 | (JP) . |
| 2696400 B2 | 9/1997 | (JP) . |
| 2700859 B2 | 10/1997 | (JP) . |
| 10-142819 A | 5/1998 | (JP) . |
| 11-52601 A | 2/1999 | (JP) . |

OTHER PUBLICATIONS

Moser et al., Phthalocyanine Compounds, "Chapter 3 Preparation", © Reinhold Publishing Corporation, 1963, pp. 104–141.

Miyazaki, "Photoreceptors for Digital Electrophography", The Society Journal, Society of Electrophotography of Japan, vol. 32, No. 3, 1993, pp. 282–289.

Oka et al., "Study of the Relationship Between Crystal Structure and Phtosensitivity of Phthalocyanine Pigments" Journal of Imaging Science and Technology, vol. 37, No. 6, Nov./Dec. 1993, pp. 607–609.

U.S. application No. 09/428,061, filed Oct. 27, 1999, entitled "Crystalline Oxotitanylphthalocyanine And Electrophotographic Photoreceptor Using the Same".

U.S. application No. 09/479,052, filed Jan. 7, 2000, entitled "Electrophotographic Photoreceptor and Electrophotographic Image Forming Process".

(List continued on next page.)

*Primary Examiner*—Christopher Rodee
(74) *Attorney, Agent, or Firm*—Nixon & Vanderhye

(57) ABSTRACT

An object of the invention is to obtain an electrophotographic photoreceptor having high sensitivity, high image quality, high stability and high resolution. A charge generating layer of the electrophotographic photoreceptor contains, as a charge generating substance, a crystalline titanyl phthalocyanine composition exhibiting, in an X-ray diffraction spectrum of a CuKα characteristic X-ray (wavelength: 1.5418 Å), at least four diffraction peaks at Bragg angles (2θ±0.2°) of 10.0° or lower, and a diffraction peak at a Bragg angle of 27.2° having an intensity smaller than the maximum diffraction intensity of the four diffraction peaks, or a lowly crystalline titanyl phthalocyanine composition exhibiting a diffraction peak having the maximum diffraction intensity at a Bragg angle (2θ±0.2°) of 27.3°. A charge transporting layer of the electrophotographic photoreceptor contains, as a charge transporting substance, a bisamine compound.

17 Claims, 5 Drawing Sheets

U.S. PATENT DOCUMENTS

| | | | | |
|---|---|---|---|---|
| 4,387,149 | | 6/1983 | Emoto et al. . | |
| 4,471,039 | | 9/1984 | Borsenberger et al. . | |
| 4,557,868 | | 12/1985 | Page et al. . | |
| 4,725,519 | | 2/1988 | Suzuki et al. . | |
| 4,732,832 | | 3/1988 | Nogami et al. . | |
| 4,871,635 | | 10/1989 | Seki et al. . | |
| 4,898,799 | | 2/1990 | Fujimaki et al. . | |
| 5,120,627 | | 6/1992 | Nozomi et al. . | |
| 5,132,197 | | 7/1992 | Iuchi et al. . | |
| 5,194,354 | | 3/1993 | Takai et al. . | |
| 5,215,842 | * | 6/1993 | Aratani et al. | 430/58.15 |
| 5,391,448 | | 2/1995 | Katayama et al. . | |
| 5,401,600 | | 3/1995 | Aizawa et al. . | |
| 5,501,930 | | 3/1996 | Kondo et al. . | |
| 5,556,728 | | 9/1996 | Nogami et al. . | |
| 5,585,212 | | 12/1996 | Ueda . | |
| 5,677,096 | | 10/1997 | Suzuki . | |
| 5,736,282 | | 4/1998 | Tamura et al. . | |
| 5,744,271 | | 4/1998 | Aizawa et al. . | |
| 5,905,009 | | 5/1999 | Nakamura et al. . | |
| 5,958,638 | | 9/1999 | Katayama et al. . | |
| 5,965,311 | | 10/1999 | Suzuki . | |
| 5,972,551 | * | 10/1999 | Miyauchi et al. | 430/59.5 |
| 6,143,453 | * | 11/2000 | Sugimura et al. | 430/65 |
| 6,210,847 | * | 4/2001 | Miyauchi et al. | 430/59.5 |

OTHER PUBLICATIONS

Sawada, "Phthalocyanine Pigments as Electrophotographic Photoreceptive Material", Dyes and Chemicals, vol. 24, No. 6, 1979, pp. 122–128.

Nitta et al., "Ultra–Precise Method of Joining a Polygon Mirror Using a Shrink Fitter (Simplification of Joining Method)", Japan Hardcopy '96, The Annual Conference of Japan Hardcopy for the Society of Electrophotography of Japan, Jul. 10–12, 1996, pp. 117–120.

Shimzu et al., "1200 dpi LED Print Head", Japan Hardcopy '96, The Annual Conference of Japan Hardcopy for the Society of Electrophotography of Japan, Jul. 10–12, 1996, pp. 125–128.

Kawamura, "Increase of Image Quality of Electrophotography—Digital Recording Technique", Electrophotography (The Society Journal, Society of Electrophotography of Japan), vol. 26, No. 1, 1987, pp. 75–83.

U.S. application No. 09/379,639, filed Aug. 24, 1999, entitled Electro–Photographic Photoreceptor and Image–Forming Apparatus Using Same.

Database WPI, Section Ch, Week 199350, Derwent Publications Ltd., London, GB, Class A89, AN 1993–400932 XP002135887 & JP 05 303213 A (Mitsubishi Paper Mills Ltd.), Nov. 16, 1993.

Database WPI Section CH, Week 198937, Derwent Publications Ltd., London, GB; Class A89, AN 1989–267928 XP002135888 & JP 01 195455 A (Minolta Camera KK), Aug. 7, 1989.

Database WPI Section CH, Week 199011, Derwent Publications Ltd., London, GB; Class A89, AN 1990–078212 XP002135889 & JP 02 029661 A (Asahi Chem Ind Co Ltd.), Jan. 31, 1990.

Arimoto et al., "High Image Quality of Laser Printer Using Variable Spot Laser", O PLUS E, No. 198, May 5, 1996, pp. 102–106 w/partial translation.

Section Ch, Week 198941, Derwent Publications Ltd., London, GB; Class A89, AN 1989–295914 XP002124411 & JP 01 217359 A (Konica) Aug. 30, 1989.

Section Ch, Week 198913, Derwent Publications Ltd., London, GB; Class A89, AN 1989–097610 XP002124412 & JP 01 046764 A (Ricoh) Feb. 21, 1989.

* cited by examiner-

ELECTROPHOTOGRAPHIC PHOTORECEPTOR AND COATING COMPOSITION FOR CHARGE GENERATING LAYER

BACKGROUND OF THE INVENTION

1. Field of the Invention

The present invention relates to an electrophotographic photoreceptor comprising a photosensitive layer having a layered structure comprising a charge generating layer containing a titanyl phthalocyanine composition as a charge generating substance and a charge transporting layer containing a bisamine compound as a charge transporting substance, and more particularly it relates to an electrophotographic photoreceptor that is applied to a digital image forming apparatus, in which a latent image is formed on an electrophotographic photoreceptor by high density exposure of 1,200 dpi or more, and the latent image is visualized by a reverse development method using a toner having an average particle diameter of 6 $\mu$m or less.

2. Description of the Related Art

An electrophotographic technique is employed in recent years not only in the field of duplicators, but also in the fields of various printers and facsimile machines owing to its excellent instantaneousness and provision of an image having high quality and high preservability. The electrophotographic process generally comprises a step of uniformly charging an electrophotographic photoreceptor (hereinafter sometimes simply referred to as "photoreceptor"), a step of forming a latent image by exposure, a step of developing the latent image with a toner, and a step of transferring and fixing of the toner image to a receiving material. In some cases, the toner image is transferred to an intermediate receiving material, and the transferred to then receiving material.

As the photoreceptor, photoreceptors comprising an organic series material, which causes no environmental pollution and can be conveniently formed into a photosensitive layer, are developed, as well as photoreceptors comprising an inorganic series material, such as selenium, an arsenic-selenium alloy, cadmium sulfide and zinc oxide. Furthermore, in a photoreceptor of a function-separated type having a layered structure of a charge generating layer and a charge transporting layer, such advantages can be obtained that high sensitivity is obtained, materials can be selected from wide ranges, high safety can be obtained, and it can be produced at a low cost by a coating method of high productivity.

In recent years, on the other hand, digitization of image formation quickly proceeds in order to obtain an image of higher quality or to memorize and arbitrarily edit an input image. According to the trend, the digital image formation spreads to the field of general duplicators in that the analog image formation has been the mainstream, which has been limited to a laser printer and an LED (light emission diode) printer used as an output apparatus for a word processor and a computer, and a part of a color laser duplicator.

In a photoreceptor compliant to the digital image formation, a laser light source and an LED are used as recording means for recording image information on the photoreceptor. In the recording means, in particular, a near infrared light source of 780 nm and a red light source of 650 nm are frequently used. Therefore, high sensitivity to light of these wavelengths is demanded, and a crystalline phthalocyanine composition, particularly a crystalline titanyl phthalocyanine composition of high sensitivity, is being studied as a material realizing such a photoreceptor of high sensitivity. The crystalline titanyl phthalocyanine composition includes various crystalline forms, in which the size and form of the crystalline lattice are determined by agreement and disagreement of diffraction peaks in an X-ray diffraction spectrum, and the molecular arrangement in the crystalline lattice is determined by the relative intensities of the diffraction peaks. In the photoreceptor using the crystalline titanyl phthalocyanine, the charging property, the dark attenuation property and the sensitivity are greatly changed by the size and form of the crystalline lattice and the molecular arrangement in the crystalline lattice.

As described in the foregoing, the digital image formation employs a laser light source and an LED as the recording means for recording image information on the photoreceptor. In this case, because an image is expressed by an array and an arrangement of minute dots called a pixel, a formation technique of minute spots owing to high resolution of an optical system is required, and a recording density of 1,200 dpi or more is realized by the optical system. Accordingly, a photoreceptor compliant to the high density recording of 1,200 dpi or more is demanded.

Japanese Examined Patent Publication JP-B2 2696400 discloses an image forming technique, in which digital image exposure is conducted at a recording density of 600 dpi or more, and a toner having a weight average particle diameter of 8 $\mu$m or less is used. In the digital image formation of a high recording density of 1,200 dpi or more, however, it is difficult to faithfully reproduce a static latent image on a photoreceptor only by determining the weight average particle diameter of the toner as in the patent publication. Furthermore, it is necessary to design to prevent deterioration in recording density of the photoreceptor.

According to the demand of high sensitivity and long service life, a photosensitive layer having a large thickness is studied. For example, such a photosensitive layer is disclosed in Japanese Unexamined Patent Publications JP-A 3-11353 (1991), JP-A 3-63653 (1991), JP-A 3-87749 (1991), JP-A 3-56966 (1991), JP-A 6-301224 (1994), JP-A 7-244388 (1995) and JP-A 7-261415 (1995).

The conventional crystalline titanyl phthalocyanine composition of used as a charge generating substance has problems in the stability of the crystalline system and the stability of the dispersion of the crystalline substance. Furthermore, in the case where a photoreceptor having the conventional photosensitive layer is applied to an image forming apparatus of a reverse development method, there are problems in the initial stability of the charge potential, particularly the stability of the first charge potential after dark adaptation, and charge ability, i.e., the capability of charge maintenance in an initial stage and after the life. There is also a problem in that the potential characteristics are changed by the change of the environment, particularly change of the temperature, to cause formation of minute image defects. Therefore, the photoreceptors of the conventional technique cannot fully satisfy the demand of high sensitivity, high image quality and high stability.

Furthermore, high resolution of the photoreceptor itself is demanded due to proceed of high image quality, and therefore a photoreceptor of high sensitivity is required that faithfully reproduce a charge latent image with high density recording of 1,200 dpi or more, for example, high density recording of from 1,500 to 2,400 dpi. While the thickness of a photosensitive layer of a photoreceptor used for a recording density of 600 dpi or less is from 20 to 35 $\mu$m, the thickness of the photosensitive layer is set with consideration of the sensitivity required in the photoreceptor and printing durability (service life). Thus, the reproducibility of a static latent image on the photoreceptor is not considered since such does not cause any particular problem. However, when the thickness of a photosensitive layer of a photoreceptor used at a recording density of 1,200 dpi is 20 μm or more, it is difficult to faithfully reproduce a charge latent image.

When the thickness of the photosensitive layer of the photoreceptor used for high density recording is 20 μm or more, the charge is diffused depending on the transportation distance of the charge within the photosensitive layer to deteriorate the resolution. For example, according to simulation, when the thickness of the photosensitive layer is 30 μm, the deterioration of the charge latent image due to diffusion of charge spreads to about 25 μm. In order to prevent deterioration in resolution on forming a charge latent image in a photoreceptor requiring high resolution, the surface charge density is increased, or the thickness of the photosensitive layer is decreased to such a level that the deterioration due to the diffusion of charge does not cause problem. When the thickness of the photosensitive layer is decreased, however, a problem is caused in that the electric field intensity applied to the photosensitive layer is increased to lower the voltage resistance. The substantive sensitivity is also decreased due to increase of the electric capacitance. The decrease in voltage resistance brings about formation of minute image defects in the reverse development. The decrease in substantive sensitivity brings about decrease in contrast, and therefore in order to ensure the sufficient image density, the surface potential has to be further increased, and the electric power of the light source has to be increased.

Japanese Examined Patent Publication JP-B2 5-55860 (1993) discloses a lamination type electrophotographic photoreceptor comprising a charge generating layer formed with a coating composition comprising a titanyl phthalocyanine compound dispersed in a binder resin and a charge transporting layer containing a hydrazone compound. However, it cannot satisfy all the requirements, i.e., high sensitivity, high image quality, high stability and high resolution. As a photoreceptor satisfying all the requirements, an a-Si series photoreceptor achieving a sensitivity of 0.1 $\mu J/cm^2$ can be exemplified. However, such a photoreceptor involves problems in environment and layer forming property. Thus, an organic series photoreceptor is demanded, in which no environmental pollution is caused, the formation of layers can be conducted conveniently, i.e., the production thereof is convenient, and all the requirement are satisfied. Furthermore, in particular, a coating composition that can be suitably used for forming a charge generating layer of the organic series photoreceptor is also demanded.

SUMMARY OF THE INVENTION

An object of the invention is to provide an electrophotographic photoreceptor having high sensitivity, high image quality, high stability and high resolution, and a coating composition that is suitably used for forming a charge generating layer of the photoreceptor.

In a first aspect, the invention relates to an electrophotographic photoreceptor comprising a conductive support, and a photosensitive layer having a layered structure comprising a charge generating layer and a charge transporting layer, the photosensitive layer being formed on the conductive support, the charge generating layer comprising a crystalline titanyl phthalocyanine composition as a charge generating substance, the charge transporting layer comprising a bisamine compound represented by a general formula (I) as a charge transporting substance, the crystalline titanyl phthalocyanine composition exhibiting at least four diffraction peaks at Bragg angles (2θ±0.2°) of 10.0° or lower and a diffraction peak at a Bragg angle of 27.2°, a maximum diffraction intensity of the four diffraction peaks at Bragg angles of 10.0° or lower being larger than the diffraction peak intensity at a Bragg angle of 27.2° in an X-ray diffraction spectrum of a Cukα characteristic X-ray (Wavelength : 1.5418Å).

(I)

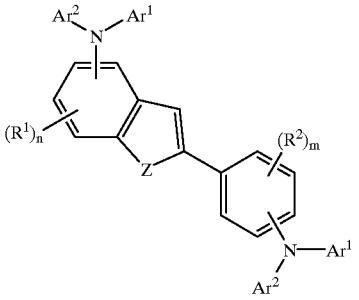

wherein $Ar^1$ and $Ar^2$ each represent an aryl group, which may have a substituent, a heterocyclic group, which may have a substituent, an aralkyl group, which may have a substituent, or an alkyl group substituted with a heterocyclic group, which may have a substituent; Z represents an atom of O, S or Se; $R^1$ and $R^2$ each represent an alkyl, alkoxy or dialkylamino group having from 1 to 3 carbon atoms, which may have a substituent, or a halogen atom or a hydrogen atom; m represents an integer of from 1 to 4; and n represents an integer of from 1 to 3, provided that when m and n are 2 or more, $R^1$ and $R^2$ may be the same as or different from each other, and may form a ring.

According to the invention, a photosensitive layer provided on the conductive support has a layered structure comprising a charge generating layer containing the crystalline titanyl phthalocyanine composition exhibiting the specific X-ray diffraction spectrum as a charge generating substance and a charge transporting layer containing the bisamine compound represented by the general formula (I) as a charge transporting substance. It has been found that in comparison to a photoreceptor containing a titanyl phthalocyanine composition not exhibiting the X-ray diffraction spectrum shown in the foregoing as a charge generating substance, the electrophotographic photoreceptor having the photosensitive layer described in the foregoing is excellent in the sensitivity characteristics and the repeated use characteristics. Furthermore, it has been also found that in the case where the photoreceptor is applied to an image forming apparatus of reverse development, it is excellent in the initial stability of the charge potential, particularly the stability of the first charge potential after the dark adaptation. Therefore, in such an image forming apparatus, a process design can be realized in that an image can be formed on the first image formation cycle.

In the photoreceptor, the change of the potential characteristics due to the change of environment is small, and the charge maintaining ability is excellent, so as to form an image of high quality with less minute defects.

A coating composition for a charge generating layer containing the crystalline titanyl phthalocyanine composition as a charge generating substance, as described above, is excellent in the dispersion stability.

Therefore, the photoreceptor can be suitably installed in an image forming apparatus of high sensitivity, such as a laser printer and a digital duplicator using a semiconductor laser light source.

The invention is characterized in that the charge generating layer further comprises a polyvinyl butyral resin having a butyralation degree of 50% by mol or more and less than 70% by mol.

According to the embodiment, it has been found that particularly in the photoreceptor applied to the image formation of high resolution, because the polyvinyl butyral resin having a butyralation degree in the specified range is used in the charge generating layer, an excellent stability of the coating composition for the charge generating layer and an excellent stability of the crystalline form of the charge generating substance, and the charge generating layer can be conveniently formed in to a layer, in comparison to a photoreceptor not containing the polyvinyl butyral resin.

The invention is characterized in that the charge generating layer further comprises a polymer of a vinyl compound or a copolymer of a vinyl compound.

According to the embodiment, it has been found that particularly in the photoreceptor applied to the image formation of high resolution, because the polymer of a vinyl compound or the copolymer of a vinyl compound is used as a binder resin, an excellent stability of the coating composition for the charge generating layer and an excellent stability of the crystalline form of the charge generating substance, and the charge generating layer can be conveniently formed in to a layer, in comparison to a photoreceptor not containing the polymer of a vinyl compound or the copolymer of a vinyl compound.

The invention is characterized in that the intensity of the diffraction peak at a Bragg angle of 27.2° is from 40% to 80% of the maximum diffraction intensity of the four diffraction peaks at Bragg angles of 10.0° or lower.

According to the embodiment, it has been found that the crystalline titanyl phthalocyanine composition exhibiting such an X-ray diffraction spectrum is particularly preferable as the crystalline titanyl phthalocyanine composition.

The invention is characterized in that at least one of the four diffraction peaks at Bragg angles of 10.0° or lower is present at a Bragg angle of 7.3°, 9.0°, 9.3°, 9.5° or 9.7°.

According to the embodiment, it has been found that the crystalline titanyl phthalocyanine composition exhibiting such an X-ray diffraction spectrum is particularly preferable as the crystalline titanyl phthalocyanine composition.

In a second aspect the invention also relates to an electrophotographic photoreceptor comprising a conductive support, and a photosensitive layer having a layered structure comprising a charge generating layer and a charge transporting layer, the photosensitive layer being formed on the conductive support, the charge generating layer comprising, as a charge generating substance, a crystalline titanyl phthalocyanine composition exhibiting a maximum diffraction intensity at a Bragg angle (2θ±0.2°) of 27.3° in an X-ray diffraction spectrum of a CuKα characteristic X-ray (wavelength: 1.5418 Å), the charge transporting layer comprising, as a charge transporting substance, a bisamine compound represented by the general formula (I).

(I)

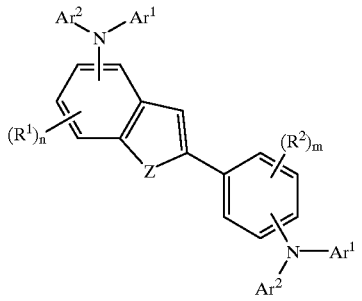

wherein $Ar^1$ and $Ar^2$ each represent an aryl group, which may have a substituent, a heterocyclic group, which may have a substituent, an aralkyl group, which may have a substituent, or an alkyl group substituted with a heterocyclic group, which may have a substituent; Z represents an atom of O, S or Se; $R^1$ and $R^2$ each represent an alkyl, alkoxy or dialkylamino group having from 1 to 3 carbon atoms, which may have a substituent, or a halogen atom or a hydrogen atom; m represents an integer of from 1 to 4; and n represents an integer of from 1 to 3, provided that when m and n are 2 or more, $R^1$ and $R^2$ may be the same as or different from each other, and may form a ring.

According to the invention, a photosensitive layer provided on the conductive support has a layered structure comprising a charge generating layer containing the relatively low crystalline titanyl phthalocyanine exhibiting the specific X-ray diffraction spectrum as a charge generating substance and a charge transporting layer containing the bisamine compound represented by the general formula (I) as a charge transporting substance. It has been found that in comparison to a photoreceptor containing a titanyl phthalocyanine composition not exhibiting the X-ray diffraction spectrum shown in the foregoing as a charge generating substance, the electrophotographic photoreceptor having the photosensitive layer described in the foregoing is excellent in the sensitivity characteristics and the repeated use characteristics. Furthermore, it has been also found that in the case where the photoreceptor is applied to an image forming apparatus of reverse development, it is excellent in the initial stability of the charge potential, particularly the stability of the first charge potential after the dark adaptation. Therefore, in such an image forming apparatus, a process design can be realized in that an image can be formed on the first image formation cycle.

In the photoreceptor, the change of the potential characteristics due to the change of environment is small, and the charge maintaining ability is excellent, so as to form an image of high quality with less minute defects.

A coating composition for a charge generating layer containing the relatively low crystalline titanyl phthalocyanine composition as a charge generating substance, as described above, is excellent in the dispersion stability.

Therefore, the photoreceptor can be suitably installed in an image forming apparatus of high sensitivity, such as a laser printer and a digital duplicator using a semiconductor laser light source.

The invention is characterized in that the crystalline titanyl phthalocyanine composition further exhibits, in the X-ray diffraction spectrum, plural diffraction peaks at Bragg angles of from 9.0 to 10.0°, and a diffraction peak at a Bragg angle of 24.0° that is broader than the diffraction peak at a Bragg angle of 27.3°.

According to the embodiment, it has been found that the titanyl phthalocyanine composition exhibiting such an X-ray diffraction spectrum is particularly preferable as the titanyl phthalocyanine composition.

The invention is characterized in that the plural diffraction peaks present at Bragg angles of from 9.0 to 10.0° and the diffraction peak present at a Bragg angle of 24.0° have intensities of 25% or less of a diffraction intensity at a Bragg angle of 27.3°, and contain a diffraction peak indicating an amorphous pattern.

According to the embodiment, it has been found that the titanyl phthalocyanine composition exhibiting such an X-ray diffraction spectrum is also particularly preferable as the titanyl phthalocyanine composition.

The invention is characterized in that at least one of the plural diffraction peaks present at a Bragg angle of from 9.0 to 10.0° is present at a Bragg angle of 9.1°, 9.3° or 9.5°.

According to the embodiment, it has been found that the phthalocyanine composition exhibiting such an X-ray diffraction spectrum is also particularly preferable as the phthalocyanine composition.

The invention is characterized in that the bisamine compound represented by the general formula (I) is represented by a general formula (II):

(II)

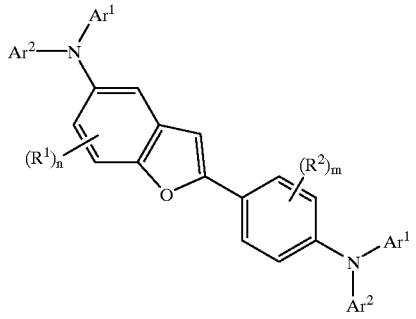

wherein $Ar^1$ and $Ar^2$ each represent an aryl, heterocyclic, group, which may have a substituent, a heterocyclic group, which may have a substituent, an aralkyl group, which may have a substituent, or an alkyl group substituted with a heterocyclic group, which may have a substituent; $R^1$ and $R^2$ each represent an alkyl, alkoxy or dialkylamino group having from 1 to 3 carbon atoms, which may have a substituent, or a halogen atom or a hydrogen atom; m represents an integer of from 1 to 4; and n represents an integer of from 1 to 3, provided that when m and n are 2 or more, $R^1$ and $R^2$ may be the same as or different from each other, and may form a ring.

According to the embodiment, it has been found that the bisamine compound represented by the general formula (II) is preferable as the bisamine compound used as the charge transporting substance in the charge transporting layer of the photoreceptor.

The invention is characterized in that the bisamine compound represented by the general formula (II) is represented by a general formula (III):

(III)

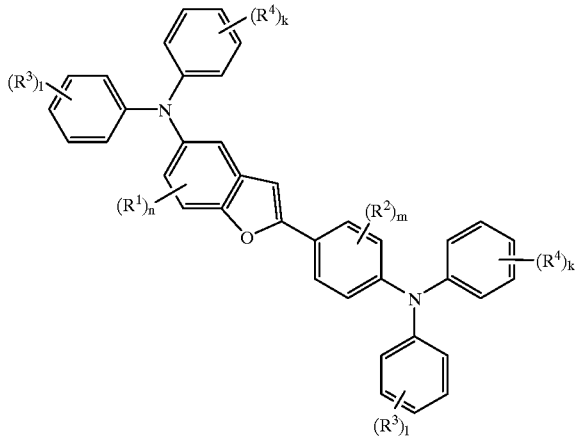

wherein $R^1$ and $R^2$ each represent an alkyl, alkoxy or dialkylamino group having from 1 to 3 carbon atoms, which may have a substituent, or a halogen atom or a hydrogen atom; $R^3$ and $R^4$ each represent an alkyl group, which may have a substituent, an alkoxy group, which may have a substituent, a dialkylamino group, which may have a substituent, or a hydrogen atom; m represents an integer of from 1 to 4; and n, l and k each represent an integer of from 1 to 3, provided that when m and n are 2 or more, $R^1$ and $R^2$ may be the same as or different from each other, and may form a ring, when 1 and k are 2 or more, $R^3$ and $R^4$ may be the same as or different from each other, and may form a ring.

According to the embodiment, it has been found that the bisamine compound represented by the general formula (III) is preferable as the bisamine compound used as the charge transporting substance in the charge transporting layer of the photoreceptor.

The invention is characterized in that the photoreceptor further comprises an intermediate layer between the conductive support and the photosensitive layer.

According to the embodiment, the intermediate layer is provided between the conductive support and the photosensitive layer. Therefore, in the case where the photosensitive layer is formed by a dip coating method of a coating composition for the charge generating layer containing the crystalline titanyl phthalocyanine composition as a charge generating substance, the influence of the heat capacity of the conductive support caused by the evaporation latent heat of a dispersion solvent can be relaxed.

The invention is characterized in that the intermediate layer contains rutile type titanium oxide and a polyamide, the rutile type titanium oxide is contained in an amount of from 30 to 50% by weight based on the total weight of the intermediate layer, and the intermediate layer, the charge generating layer and the charge transporting layer are laminated in this order on the conductive support.

According to the embodiment, it is especially preferable that the intermediate layer contains the rutile type titanium oxide in an amount of from 30 to 50% by weight based on the total weight thereof and further contains the polyamide. When the intermediate layer is provided on the conductive support, and the charge generating layer and the charge transporting layer are laminated thereon in this order to form a photoreceptor, the stability of the potential characteristics and the effect of preventing image defects are improved.

The invention is characterized in that the electrophotographic photoreceptor is for use in image forming apparatuses in which a latent image is formed on an electrophotographic photoreceptor by conducting high density exposure of 1,200 dpi or more, which latent image is visualized by a reverse development method using a toner having an average particle diameter of 6 μm or less, and the charge transporting layer has a thickness of from 10 to 20 μm.

According to the embodiment, it has been found that when the thickness of the charge transporting layer of the photoreceptor applied to the image formation of particularly high resolution is in the range described in the foregoing, extremely high sensitivity can be obtained. It has also found that an image of high resolution and high quality can be obtained by defining the thickness of the charge transporting layer to the range described in the foregoing.

The invention is characterized in that the charge generating layer further comprises a butyralated binder resin.

According to the embodiment, it has been found that when the butyralated binder resin is used in the charge generating layer of the photoreceptor applied to the image formation of particularly high resolution, the stability in the coating composition for the charge generating layer and the stability in the crystalline form of the charge generating substance.

The invention is characterized in that the charge transporting layer comprises, as a binder resin, a polycarbonate represented by a general formula (IV) selected to have a viscosity average molecular weight of from 35,000 to 85,000:

(IV)

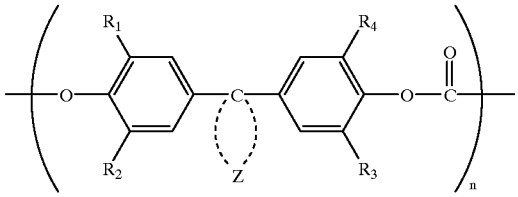

wherein R1 to R4 each represent a hydrogen atom, a halogen atom or an alkyl group having from 1 to 4 carbon atoms; and Z represents an atomic group for forming a substituted or unsubstituted carbon ring or a substituted or unsubstituted heterocycle.

According to the embodiment, it has been found that the use of the binder resin described in the foregoing in the charge transporting layer of a photoreceptor applied to the image formation of particularly high resolution is preferable for obtaining an image of high sensitivity, high resolution and high quality.

The invention is characterized in that the charge transporting layer contains, as an antioxidant, a hindered phenol.

According to the embodiment, it has been found that when the hindered phenol is used as an antioxidant in the charge transporting layer of a photoreceptor applied to the image formation of particularly high resolution is preferable for stabilization of the potential characteristics.

The invention is characterized in that the hindered phenol is contained in an amount of from 0.5 to 10% by weight based on the charge transporting substance.

According to the embodiment, it has been found that when the antioxidant described in the foregoing is used in the charge transporting layer of a photoreceptor applied to the image formation of particularly high resolution is preferable for the stabilization of the potential characteristics.

In a third aspect the invention also relates to a coating composition for a charge generating layer of an electrophotographic photoreceptor, the coating composition comprising a crystalline titanyl phthalocyanine composition exhibiting, in an X-ray diffraction spectrum of a CuKα characteristic X-ray (wavelength: 1.5418 Å), at least four diffraction peaks at Bragg angles (2θ±0.2°) of 10.0° or lower and a diffraction peak at a Bragg angle of 27.2°, the maximum diffraction intensity of the four diffraction peaks at Bragg angles of 10.0° or lower being larger than a diffraction peak intensity at a Bragg angle of 27.2°, a binder resin, and a ketone series solvent.

According to the invention, the coating composition for a charge generating layer containing the crystalline titanyl phthalocyanine composition as a charge generating substance exhibiting the X-ray diffraction spectrum described in the foregoing is excellent in dispersion stability. It has been found that in the coating composition for the charge generating layer, when the crystalline titanyl phthalocyanine composition, the binder resin and the ketone series solvent are contained, the dispersion stability is particularly excellent. It has also been found that, considering the environment, the coating composition is relatively low in causing environmental pollution. It has also been found that an electrophotographic photoreceptor comprising a conductive support having thereon a photosensitive layer having a charge generating layer formed by using the coating composition exhibits excellent photosensitivity characteristics and excellent repeated use characteristics, in comparison to a photoreceptor having a charge generating layer formed by using a coating composition for a charge generating layer not containing the crystalline titanyl phthalocyanine composition, the binder resin and the ketone series solvent.

Furthermore, it has been also found that an image forming apparatus of reverse development having the electrophotographic photoreceptor installed therein is excellent in the initial stability of the charge potential, particularly the stability of the first charge potential after the dark adaptation. Therefore, in such an image forming apparatus, a process design can be realized in that an image can be formed on the first image formation cycle.

Furthermore, the electrophotographic photoreceptor exhibits a small change in potential characteristics due to the change in environment, and an excellent charge maintaining capability, so as to form an image of high quality with less minute defects. Therefore, an electrophotographic photoreceptor of high sensitivity, high image quality, high stability and high resolution can be provided. The photoreceptor having a charge generating layer formed by using the coating composition for a charge generating layer can be suitably installed in an image forming apparatus of high sensitivity, such as a laser printer and a digital duplicator using a semiconductor laser light source.

The invention is characterized in that the diffraction peak intensity at a Bragg angle of 27.2° is in a range of from 40 to 80% of a maximum diffraction intensity of the four diffraction peaks at Bragg angles of 10.0° or lower.

According to the embodiment, it has been found that the crystalline titanyl phthalocyanine composition contained in the coating composition for a charge generating layer is preferably the crystalline titanyl phthalocyanine composition exhibiting the X-ray diffraction spectrum described in the foregoing.

The invention is characterized in that at least one of the four diffraction peaks at Bragg angles of 10.0° or lower is present at a Bragg angle of 7.3°, 9.0°, 9.3°, 9.5° or 9.7°.

According to the embodiment, it has been found that the crystalline titanyl phthalocyanine composition contained in the coating composition for a charge generating layer as a charge generating substance is preferably the crystalline titanyl phthalocyanine composition exhibiting the X-ray diffraction spectrum described in the foregoing.

In a fourth aspect the invention also relates to a coating composition for a charge generating layer of an electrophotographic photoreceptor, the coating composition comprising a crystalline titanyl phthalocyanine composition exhibiting a maximum diffraction peak intensity at a Bragg angle (2θ±0.2°) of 27.3° in an X-ray diffraction spectrum of a CuKα characteristic X-ray (wavelength: 1.5418 Å), a binder resin, and a ketone series solvent.

According to the invention, the coating composition for a charge generating layer containing the relatively low crystalline titanyl phthalocyanine composition as a charge generating substance exhibiting the X-ray diffraction spectrum described in the foregoing is excellent in dispersion stability. It has been found that in the coating composition for the charge generating layer, when the crystalline titanyl phthalocyanine composition, the binder resin and the ketone series solvent are mainly contained, the dispersion stability is particularly excellent. It has also been found that, considering the environment, the coating composition causes no environmental pollution. It has also been found that an electrophotographic photoreceptor comprising a conductive support having thereon a photosensitive layer having a charge generating layer formed by using the coating composition exhibits excellent photosensitivity characteristics and excellent repeated use characteristics, in comparison to a photoreceptor having a charge generating layer formed by using a coating composition for a charge generating layer not mainly containing the crystalline titanyl phthalocyanine composition, the binder resin and the ketone series solvent.

Furthermore, it has been also found that an image forming apparatus of reverse development having the electrophotographic photoreceptor installed therein is excellent in the initial stability of the charge potential, particularly the stability of the first charge potential after the dark adaptation. Therefore, in such an image forming apparatus, a process design can be realized in that an image can be formed on the first image formation cycle.

Furthermore, the electrophotographic photoreceptor exhibits a small change in potential characteristics due to the change in environment, and an excellent charge maintaining capability, so as to form an image of high quality with less minute defects. Therefore, an electrophotographic photoreceptor of high sensitivity, high image quality, high stability and high resolution can be provided. The photoreceptor having a charge generating layer formed by using the coating composition for a charge generating layer can be suitably installed in an image forming apparatus of high sensitivity, such as a laser printer and a digital duplicator using a semiconductor laser light source.

The invention is characterized in that the crystalline titanyl phthalocyanine composition further exhibits, in the X-ray diffraction spectrum, plural diffraction peaks at Bragg angles of from 9.0 to 10.0°, and a diffraction peak at a Bragg angle of 24.0° that is broader than the diffraction peak at a Bragg angle of 27.3°.

According to the embodiment, it has been found that the crystalline titanyl phthalocyanine composition contained in the coating composition for a charge generating layer as a charge generating substance is preferably the crystalline titanyl phthalocyanine composition exhibiting the X-ray diffraction spectrum described in the foregoing.

The invention is characterized in that the plural diffraction peaks present at Bragg angles of from 9.0 to 10.0° and the diffraction peak present at a Bragg angle of 24.0° have intensities of 25% or less of an intensity of the diffraction peak present at a Bragg angle of 27.3°, and contain a diffraction peak indicating an amorphous pattern.

According to the embodiment, it has been found that the crystalline titanyl phthalocyanine composition contained in the coating composition for a charge generating layer as a charge generating substance is preferably the crystalline titanyl phthalocyanine composition exhibiting the X-ray diffraction spectrum described in the foregoing.

The invention is characterized in that at least one of the plural diffraction peaks present at Bragg angles of from 9.0 to 10.0° is present at a Bragg angle of 9.1°, 9.3° or 9.5°.

According to the embodiment, it has been found that the crystalline titanyl phthalocyanine composition contained in the coating composition for a charge generating layer as a charge generating substance is preferably the crystalline titanyl phthalocyanine composition exhibiting the X-ray diffraction spectrum described in the foregoing.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
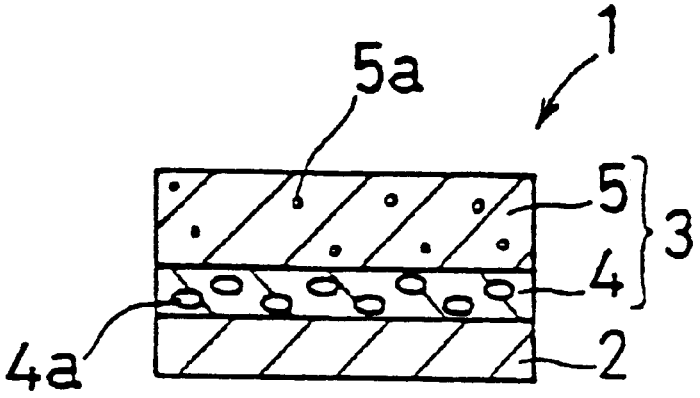
FIG. 1A and FIG. 1B are cross sectional views showing electrophotographic photoreceptors 1 and 7, which are examples of the invention.

Now referring to the drawings, preferred embodiments of the invention are described below.

Figure 1B:
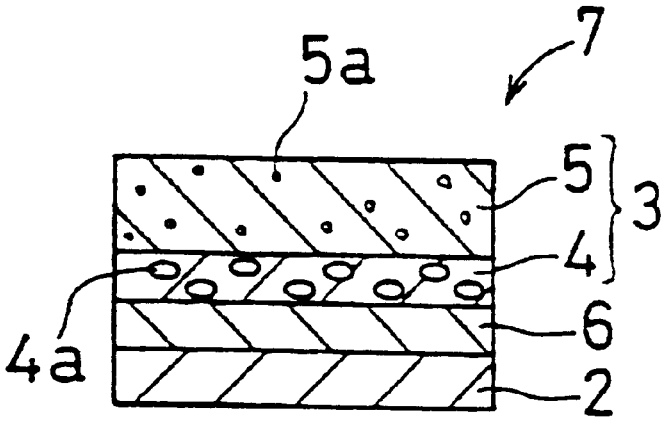

FIG. 1A and FIG. 1B are cross sectional views showing electrophotographic photoreceptors 1 and 7, which are examples of the invention. The photoreceptor 1 shown in FIG. 1A comprises a conductive support 2 having thereon a photosensitive layer 3, and the photoreceptor 7 shown in FIG. 1B further comprises an intermediate layer 6 between the conductive support 2 and the photosensitive layer 3. In both the photoreceptors 1 and 7, the photosensitive layer 3 is a function-separated type photoreceptor having a layered structure comprising a charge generating layer 4 containing a charge generating substance 4*a* and a charge transporting layer 5 containing a charge transporting substance 5*a*. In the examples, the charge generating layer 4 is provided on the side of the conductive support 2, and the charge transporting layer 5 is provided thereon.

As another embodiment of the invention, the charge generating layer 4 and the charge transporting layer 5 may be arranged in a reverse order. The photoreceptors 1 and 7 may further comprise an overcoating layer not shown in the figures on the photosensitive layer 3. The overcoating layer has a function of protecting the photosensitive layer 3.

The conductive support 2 may comprise a metallic material having an electric conductivity, such as aluminum, an aluminum alloy, copper, zinc, stainless steel, nickel and titanium. The conductive support 2 may be plastics or paper having on the surface thereof a vapor evaporation film comprising aluminum, gold, silver, copper, zinc, nickel, titanium, indium oxide and tin oxide. Furthermore, the plastics and paper may contain conductive particles or a conductive polymer. The shape of the conductive support 2 may be a drum form, a sheet form and a seamless belt form.

The charge generating layer 4 contains, as the charge generating substance 4*a*, a titanyl phthalocyanine composition, the basic structure of which is represented by a structural formula (V). In particular, a first crystalline titanyl phthalocyanine composition exhibiting, in an X-ray diffraction spectrum of a CuKα characteristic X-ray (wavelength: 1.5418 Å), at least four diffraction peaks in a low angle side of Bragg angles (2θ±0.2°) of 10.0° or lower, and a diffraction peak at a Bragg angle of 27.2°, where the maximum diffraction intensity of the four diffraction peaks at Bragg angles of 10.0° or lower is larger than the intensity of the diffraction peak at a Bragg angle of 27.2°, and a second lowly crystalline titanyl phthalocyanine composition exhibiting a diffraction peak of a maximum intensity at a Bragg angle (2θ±0.2°) of 27.3° are preferable.

(V)

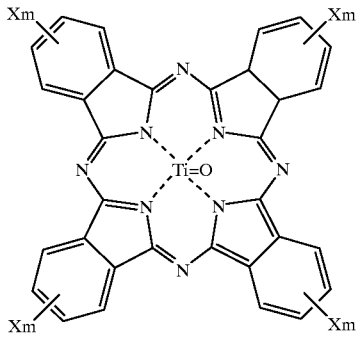

In the formula (V), X represents one of a hydrogen atom, a halogen atom, an alkyl group and an alkoxy group, and m represents an integer of from 0 to 4. The Bragg angle used herein is the so-called diffraction angle, i.e., an angle 2θ, which is twice an angle θ between a surface of a crystalline substance and an incident X-ray, with the consideration of an error of 0.2°, when the X-ray is incident on the crystalline substance to be diffracted with satisfying the Bragg's formula.

Further, it is preferable that the diffraction peak at a Bragg angle of 27.2° of the crystalline titanyl phthalocyanine composition is in a range of from 40 to 80% of a maximum diffraction intensity of the four strong diffraction peaks at Bragg angles of 10.0° or lower.

In the crystalline titanyl phthalocyanine composition, it is preferable that at least one of the four strong diffraction peaks at Bragg angles of 10.0° or lower is present at a Bragg angle of 7.3°, 9.0°, 9.3°, 9.5° or 9.7°.

As the second lowly crystalline titanyl phthalocyanine composition, one exhibiting plural diffraction peaks at Bragg angles of from 9.0 to 10.0°, and a diffraction peak at a Bragg angle of 24.0° that is broader than the diffraction peak at a Bragg angle of 27.3° is preferable.

Further, in the second lowly crystalline titanyl phthalocyanine composition, it is preferable that the plural diffraction peaks at Bragg angles of from 9.0 to 10.0° and the diffraction peak at a Bragg angle of 24.0° have intensities of 25% or less of an intensity of the diffraction peak at a Bragg angle of 27.3°, and contain a diffraction peak indicating an amorphous pattern, is preferable.

Further, in the lowly crystalline titanyl phthalocyanine composition it is preferable that at least one of the plural diffraction peaks at Bragg angles of from 9.0 to 10.0° is specifically present at a Bragg angle of 9.1°, 9.3° or 9.5°.

As a synthesis method for titanyl phthalocyanine, a method disclosed in Moser and Tomas "Phthalocyanine Compounds" and other known methods can be employed.

For example, dichlorotitanium phthalocyanine can be obtained in a good yield by melting o-phthalonitrile and titanium tetrachloride by heat or heating them in the presence of an organic solvent, such as α-chloronaphthalene. Dichlorotitanium phthalocyanine is hydrolyzed with water or a base to obtain titanyl phthalocyanine. Furthermore, titanyl phthalocyanine is obtained by heating 1,3-diiminoisoindoline and tetrabutoxytitanium in an organic solvent, such as N-methylpyrrolidone.

The resulting titanyl phthalocyanine may contain phthalocyanine derivatives where the hydrogen atom on the benzene ring is substituted by one substituent selected from among a chlorine atom, a fluorine atom, a nitro group, a cyano group and a sulfone group.

The first crystalline form of titanyl phthalocyanine of the invention can be obtained by treating the titanyl phthalocyanine with an organic solvent immiscible with water, such as dichloroethane, in the presence of water. That is, after forming titanyl phthalocyanine having a large turbulence, the solvent treatment is conducted, and a mechanical stress is applied, to convert the molecular arrangement of the titanyl phthalocyanine, whereby the crystalline form of the invention is obtained. The titanyl phthalocyanine thus produced withstands the mechanical share stress upon producing the coating composition to exhibit high stability.

The second lowly crystalline form of titanyl phthalocyanine of the invention can be obtained by treating the titanyl phthalocyanine with an organic solvent immiscible with water, such as dichloroethane, in the presence of water, and then subjecting to a milling treatment with a ketone series solvent. That is, after forming titanyl phthalocyanine having a large turbulence, the solvent treatment is conducted, and a mechanical stress is applied, to convert the molecular arrangement of the titanyl phthalocyanine, whereby the crystalline form of the invention is obtained. The titanyl phthalocyanine thus produced has a relatively low crystallinity, and withstands the mechanical share stress upon producing the coating composition to exhibit high stability.

The method for treating the titanyl phthalocyanine with the organic solvent immiscible with water includes a method, in which the titanyl phthalocyanine is swelled with water and treated with the organic solvent, and a method, in which water is added to the organic solvent without conducting the swelling treatment, and the titanyl phthalocyanine powder is put in the mixture, but the method is not limited to these.

The method for swelling the titanyl phthalocyanine with water includes a method, in which the titanyl phthalocyanine is dissolved in sulfuric acid, and deposited in water to form a wet paste, and a method, in which the titanyl phthalocyanine is swelled in water by using a stirring and dispersing apparatus, such as a homomixer, a paint mixer, a ball mill and a sand mill, to form a wet paste, but the method is not limited to these.

The crystalline form of the invention can be obtained by stirring the titanyl phthalocyanine obtained by hydrolysis for a sufficient period of time, or subjecting the titanyl phthalocyanine to a milling treatment with a mechanical stress. The control of the molecular arrangement by these treatments is preferable for titanyl phthalocyanine having a crystalline form classified to the so-called I type.

As the apparatus for conducting the treatment, a homomixer, a paint mixer, a disperser, an agitator, a ball mill, a sand mill, an attritor and an ultrasonic disperser can be used as well as a general stirring apparatus. After the treatment, the titanyl phthalocyanine is filtered and washed with methanol, ethanol and water, followed by subjecting to isolation.

The titanyl phthalocyanine composition of the invention is not limited to those produced by the production methods described in the foregoing, and those produced by any production method can be included as far as they have the X-ray diffraction spectrum that is characteristic in the invention.

The resulting titanyl phthalocyanine exhibits excellent performance as the charge generating substance 4*a* of the electrophotographic photoreceptors 1 and 7.

The charge generating layer 4 may further contain other substance than the titanyl phthalocyanine as the charge generating substance 4*a*. For example, an α-type, β-type (A-type), C-type, Y-type, M-type, M-α-type and amorphous titanyl phthalocyanine having a crystalline form different from the titanyl phthalocyanine of the invention may be contained. Other phthalocyanine compounds, an azo pigment, an anthraquinone pigment, a perylene pigment, a polycyclic quinone pigment and a squarerium pigment may further be contained.

The crystalline form of oxotitanyl phthalocyanine is classified into many crystalline forms depending on a diffraction angle in an X-ray diffraction spectrum as disclosed in Electrophotography (The Society Journal, Society of Electrophotography of Japan), Vol. 32, No. 3, pp. 282–289. For example, Japanese Patent No. JP-C 2007449 (JP-B2 6-29975) discloses an α-type, Japanese Patent No. JP-C 1917796 (JP-B2 5-31137) discloses an A-type, Japanese Patent No. JP-C 1876697 (JP-B2 6-1386) and JP-C 1997269 (JP-B2 7-30267) disclose a C-type, Japanese Patent No. JP-C 1950255 (JP-B2 6-39575) and JP-C 2128593 (JP-B2 7-91486) disclose an Y-type, Japanese Examined Patent Publication JP-B2 7-15067 (1995) discloses an M-α-type, Japanese Examined Patent Publication JP-B2 2502404 discloses an I-type, and Japanese Patent No. JP-C 1978469 (JP-B2 7-5851) discloses an M-type. Furthermore, Japanese Examined Patent Publication JP-B2 2700859 and Japanese Unexamined Patent Publication JP-A 8-209023 (1996) disclose a crystalline form basically belonging to a Y-type.

The lattice constants of a C-type, a phase I type and a phase II type have been determined by the crystalline structural analysis of oxotitanyl phthalocyanine. A phase II type belongs to the triclinic system, and a phase I type and a C-type belong to the monoclinic system. Results obtained by analysis of the crystalline forms disclosed in the publications described in the foregoing based on the known crystalline lattice constants indicate that an A-type and an I-type belong to the phase I type, an α-type and a β-type belong to the phase II type, and an M-type belongs to the C-type. These have been described in Journal of Imaging Science and Technology, Vol. 37, No. 6, 1993, pp. 607–609.

When the charge generating substance 4*a* is the first crystalline titanyl phthalocyanine, the charge generating layer 4 preferably contains a binder resin in addition to the charge generating substance 4*a*. The binder resin is preferably a polyvinyl butyral resin having a butyralation degree of 50% by mol or more and less than 70% by mol, a polymer of a vinyl compound or a copolymer of a vinyl compound. By using such a binder resin, excellent stability of the first crystalline form of the coating composition for a charge generating layer and the charge generating substance can be obtained.

When the charge generating substance 4*a* is the second lowly crystalline titanyl phthalocyanine, a butyralated resin is preferable as a binder resin particularly in a photoreceptor applied to an image forming apparatus, in which a latent image is formed on the photoreceptor by high density exposure of 1,200 dpi or more, and the latent image is visualized by a reverse development method using a toner having an average particle diameter of 6 μm. By using the butyralated binder resin in the charge generating layer, excellent stability of the second crystalline form of the coating composition for a charge generating layer and the charge generating substance can be obtained.

The binder resin is not limited to the butyralated resin, such as polyvinyl butyral having the butyralation degree specified in the foregoing, the polymer of a vinyl compound or the copolymer of a vinyl compound, such as a vinyl chloride-vinyl acetate copolymer, but a polyester resin, polyvinyl acetate, polyacrylate, polymethacrylate, polycarbonate, polyvinyl acetoacetal, polyvinyl propyonal, a phenoxy resin, an epoxy resin, a urethane resin, cellulose ester and cellulose ether may be used singly or as a mixture.

A coating composition for forming such a charge generating layer 4 is preferably a coating composition comprising the first crystalline titanyl phthalocyanine composition exhibiting, in an X-ray diffraction spectrum of a CuKα characteristic X-ray (Wavelength : 1.5418Å), at least four diffraction peaks in a low angle side of Bragg angles of 10.0° or lower, and a diffraction peak at a Bragg angle of 27.2°, where the maximum diffraction intensity of the four diffraction peaks at Bragg angles of 10.0° or lower is larger than the intensity of the diffraction peak at a Bragg angle of 27.2°, or the second lowly crystalline titanyl phthalocyanine composition exhibiting a diffraction peak having the maximum diffraction intensity at a Bragg angle of 27.3°, the binder resin and the ketone series solvent.

Further, in the first crystalline titanyl phthalocyanine composition, it is preferable that the diffraction peak intensity at a Bragg angle of 27.2° is from 40 to 80% of the maximum diffraction intensity of the four strong diffraction peaks at Bragg angles of 10.0° or lower.

Further, it is preferable in the first crystalline titanyl phthalocyanine that at least one of the four strong diffraction peaks at Bragg angles of 10.0° or lower are present at a Bragg angle of 7.3°, 9.0°, 9.3°, 9.5° or 9.7°.

As the second lowly crystalline titanyl phthalocyanine composition, one exhibiting plural diffraction peaks at Bragg angles of from 9.0 to 10.0°, and a diffraction peak at a Bragg angle of 24.0° that is broader than the diffraction peak at a Bragg angle of 27.3° is preferable.

Further, it is preferable in the second lowly crystalline titanyl phthalocyanine composition that the plural diffraction peaks at Bragg angles of from 9.0 to 10.0° and the diffraction peak at a Bragg angle of 24.0° have diffraction intensities of 25% or less of the diffraction peak at a Bragg angle of 27.3°, and contain a diffraction peak indicating an amorphous pattern.

Further, in the second lowly crystalline titanyl phthalocyanine composition, it is preferable that at least one of the plural diffraction peaks at Bragg angles of from 9.0 to 10.0° is present at a Bragg angle of 9.1°, 9.3° or 9.5°.

The solvent contained in the coating composition for a charge generating layer is preferably a ketone series solvent, such as acetone, methyl ethyl ketone, methyl isobutyl ketone and cyclohexanone. By using the ketone series solvent, excellent stability of the crystalline form of the coating composition for a charge generating layer and the charge generating substance can be obtained. Furthermore, the solvent causes relatively low environmental pollution from the standpoint of environment.

The solvent is not limited to the ketone series solvent, but an ester series solvent, such as ethyl acetate and butyl acetate, an ether series solvent, such as tetrahydrofuran and dioxane, an aromatic hydrocarbon series solvent, such as benzene, toluene and xylene, and a non-protonic solvent, such as N,N-dimethylformamide and dimethylsulfoxide may be used singly or as a mixture.

The charge generating layer 4 is produced, for example, in the following manner. A charge generating substance 4*a* and a binder resin are added to a solvent, which are pulverized and dispersed by using a ball mill, a sand grinder, a paint shaker or an ultrasonic disperser, so as to obtain a coating composition for a charge generating layer. The charge generating layer 4 is formed with the coating composition thus obtained by a coating method, such as a baker applicator, a bar coater, casting or spin coating, in the case of a sheet form. In the case of a drum form, the charge generating layer is formed by a spray method, a vertical ring method or a dip coating method. The thickness of the charge generating layer 4 is selected from the range of from 0.05 to 5 $\mu$m, and preferably from the range of from 0.08 to 1 $\mu$m.

The charge transporting layer 5 contains a charge transporting substance 5*a*. The charge transporting substance 5*a* has the bisamine structure represented by the general formula (I):

(I)

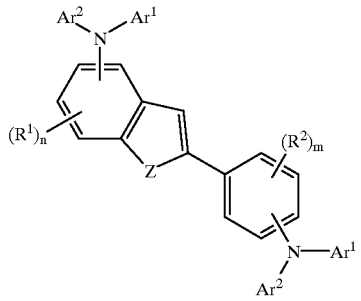

wherein $Ar^1$ and $Ar^2$each represent an aryl group, which may have a substituent, a heterocyclic group, which may have a substituent, an aralkyl group, which may have a substituent, or an alkyl group substituted with a heterocyclic group, which may have a substituent; Z represents an atom of O, S or Se; $R^1$ and $R^2$ each represent an alkyl, alkoxy or dialkylamino group having from 1 to 3 carbon atoms, which may have a substituent, or a halogen atom or a hydrogen atom; m represents an integer of from 1 to 4; and n represents an integer of from 1 to 3, provided that when m and n are 2 or more, $R^1$ and $R^2$ may be the same as or different from each other, and may form a ring.

The bisamine compound is preferably a bisamine compound represented by the general formula (II):

(II)

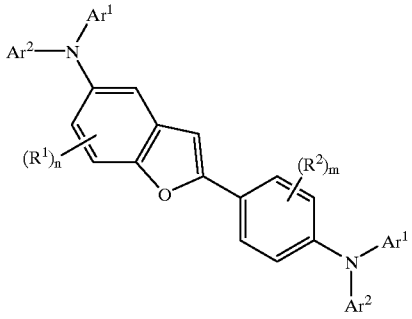

wherein $Ar^1$ and $Ar^2$each represent an aryl group, which may have a substituent, a heterocyclic group, which may have a substituent, an aralkyl group, which may have a substituent, or an alkyl group substituted with a heterocyclic group, which may have a substituent; $R^1$ and $R^2$ each represent an alkyl, alkoxy or dialkylamino group having from 1 to 3 carbon atoms, which may have a substituent, or a halogen atom or a hydrogen atom; m represents an integer of from 1 to 4; and n represents an integer of from 1 to 3, provided that when m and n are 2 or more, $R^1$ and $R^2$ may be the same as or different from each other, and may form a ring.

Further, the bisamine compound is preferably a bisamine compound represented by the general formula (III):

(III)

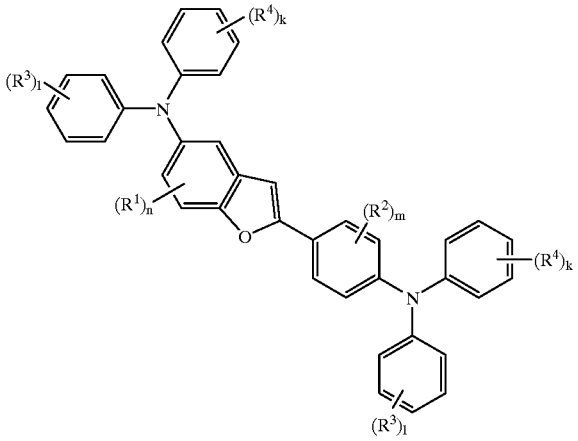

wherein $R^1$ and $R^2$ each represent an alkyl, alkoxy or dialkylamino group having from 1 to 3 carbon atoms, which may have a substituent, or a halogen atom or a hydrogen atom; $R^3$ and $R^4$ each represent an alkyl group, which may have a substituent, an alkoxy group, which may have a substituent, a dialkylamino group, which may have a substituent, or a hydrogen atom; m represents an integer of from 1 to 4; and n, k and leach represent an integer of from 1 to 3, provided that when m and n are 2 or more, $R^1$ and $R^2$ may be the same as or different from each other, and may form a ring, when k and 1 are 2 or more, $R^3$ and $R^4$ may be the same as or different from each other, and may form a ring.

The bisamine compounds represented by the general formula (II) and the general formula (III) are preferable from the standpoint of the synthesis cost. Specific examples of the bisamine compound will be described in Tables 1 to 5, but the bisamine compound of the invention is not limited to them.
TABLE 1
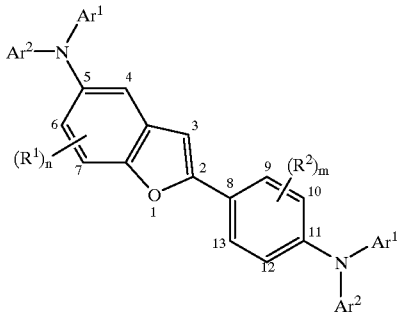
| Example Compound No. | $(R^1)_n$ | $(R^2)_m$ | $Ar^1$ | $Ar^2$ |
|---|---|---|---|---|
| 1 | H | H | 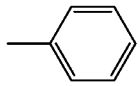 | 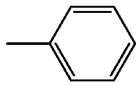 |
| 2 | H | H | 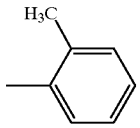 | 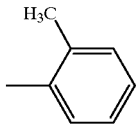 |
| 3 | H | H | 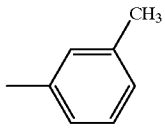 | 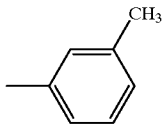 |
| 4 | H | H | 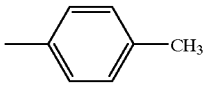 | 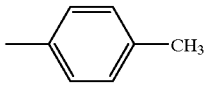 |
| 5 | H | H | 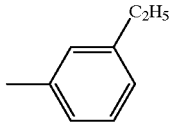 | 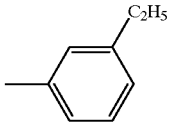 |
| 6 | H | H | 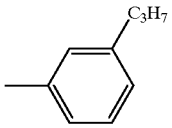 | 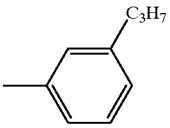 |
| 7 | H | H | 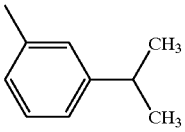 | 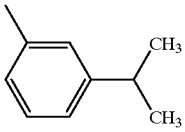 |
| 8 | H | H | 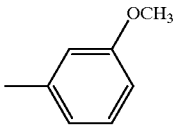 | 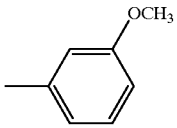 |

TABLE 1-continued
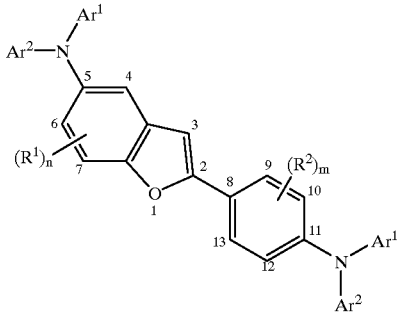
| Example Compound No. | $(R^1)_n$ | $(R^2)_m$ | $Ar^1$ | $Ar^2$ |
|---|---|---|---|---|
| 9 | H | H | 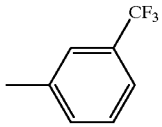 | 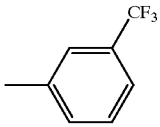 |
| 10 | H | H | 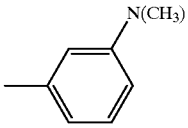 | 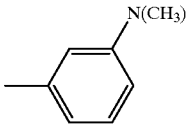 |
| 11 | H | H | 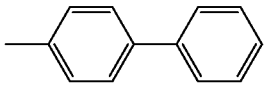 | 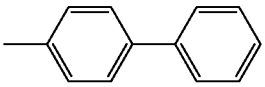 |
TABLE 2
| | | | | |
|---|---|---|---|---|
| 12 | H | H | 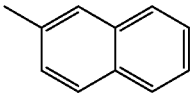 | 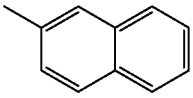 |
| 13 | H | H | 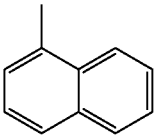 | 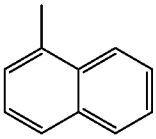 |
| 14 | H | H | 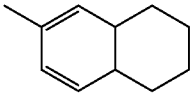 | 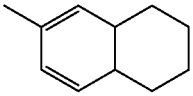 |
| 15 | H | H | 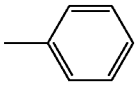 | 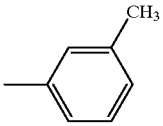 |

TABLE 2-continued
| | | | | |
|---|---|---|---|---|
| 16 | H | H | 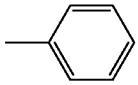 | 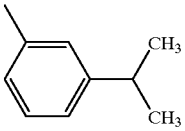 |
| 17 | H | H | 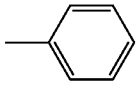 | 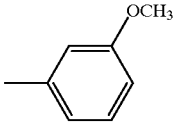 |
| 18 | H | H | 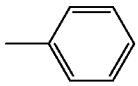 | 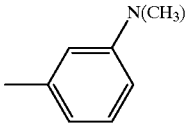 |
| 19 | H | H | 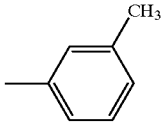 | 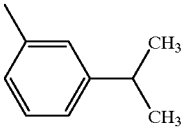 |
| 20 | H | H | 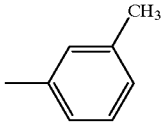 | 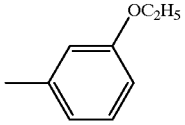 |
| 21 | H | H | 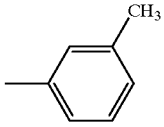 | 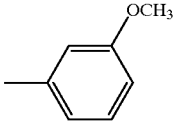 |
| 22 | H | H | 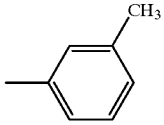 | 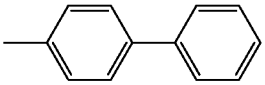 |
| 23 | H | H | 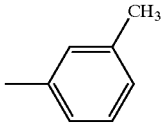 | 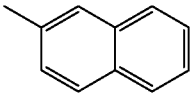 |
| 24 | H | H | 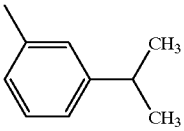 | 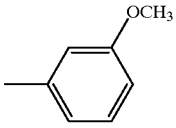 |
| 25 | H | H | 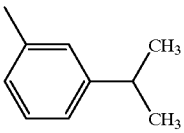 | 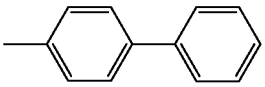 |

TABLE 3
| | | | | |
|---|---|---|---|---|
| 26 | H | H | 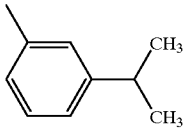 | 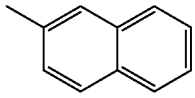 |
| 27 | 7-$OCH_3$ | H | 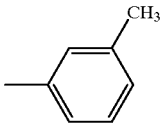 | 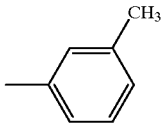 |
| 28 | 7-$OCH_3$ | H | 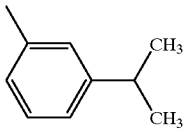 | 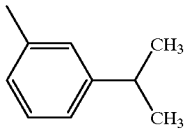 |
| 29 | 7-$OCH_3$ | H | 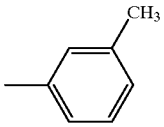 | 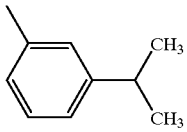 |
| 30 | 7-$OCH_3$ | H | 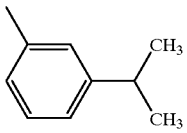 | 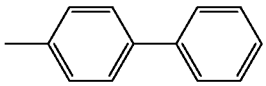 |
| 31 | 7-$OCH_3$ | H | 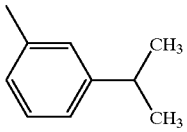 | 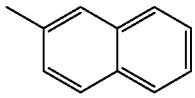 |
| 32 | H | 10-$CH_3$ | 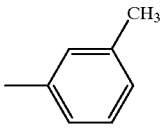 | 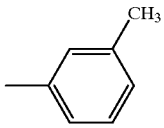 |
| 33 | H | 10-$CH_3$ | 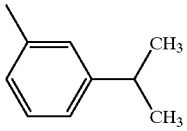 | 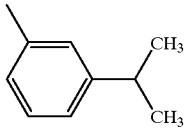 |
| 34 | H | 10-$CH_3$ | 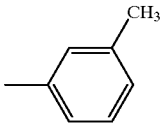 | 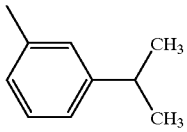 |
| 35 | H | 10-$CH_3$ | 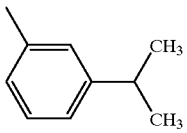 | 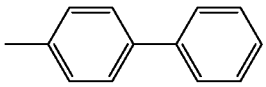 |

TABLE 3-continued
| | | | | |
|---|---|---|---|---|
| 36 | H | 10-$CH_3$ | 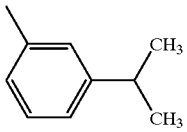 | 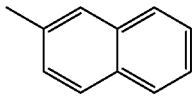 |
| 37 | H | 9-$CH_3$,10-$CH_3$ | 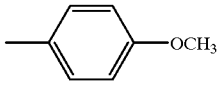 | 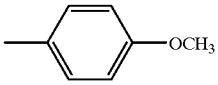 |
TABLE 4
| | | | | |
|---|---|---|---|---|
| 38 | H | 9-$CH_3$,10-$CH_3$ | 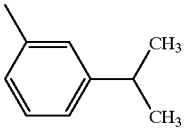 | 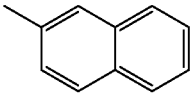 |
| 39 | 7-$OCH_3$ | 10-$CH_3$ | 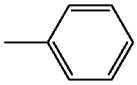 | 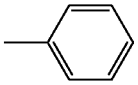 |
| 40 | 7-$OCH_3$ | 10-$CH_3$ | 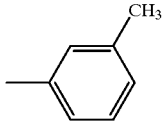 | 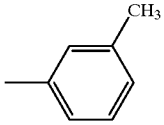 |
| 41 | 7-$CH_3$ | 10-$CH_3$ | 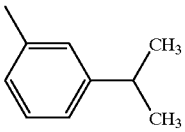 | 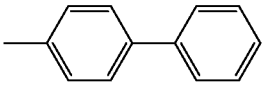 |
| 42 | 7-$OCH_3$ | 10-$CH_3$ | 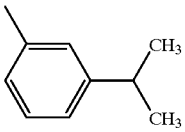 | 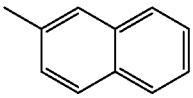 |
| 43 | 7-$OCH_3$ | 9-$CH_3$,10-$CH_3$ | 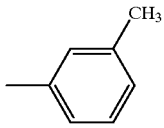 | 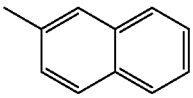 |

TABLE 5
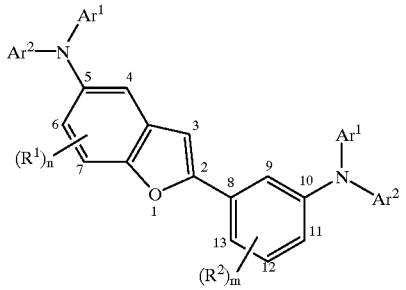
| Example Compound No. | $(R^1)_n$ | $(R^2)_m$ | $Ar^1$ | $Ar^2$ |
|---|---|---|---|---|
| 44 | H | H | 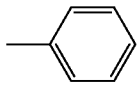 | 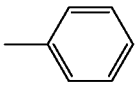 |
| 45 | H | H | 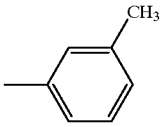 | 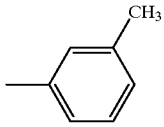 |
| 46 | H | H | 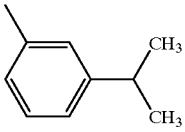 | 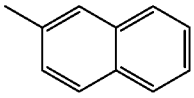 |
| 47 | 7-$OCH_3$ | H | 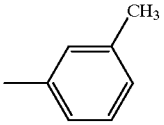 | 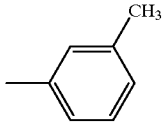 |
| 48 | H | 12-$CH_3$ | 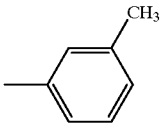 | 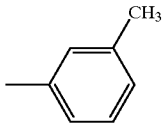 |
| 49 | 7-$OCH_3$ | 12-$CH_3$ | 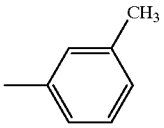 | 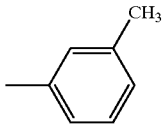 |
| 50 | 7-$OCH_3$ | 9-$CH_3$,10-$CH_3$ | 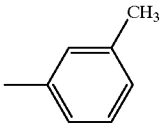 | 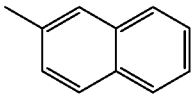 |

As the charge transporting substance 5*a,* one or two or more of the bisamine compounds described in the foregoing can be contained. Furthermore, other charge transporting substances may also be contained.

Further, the charge transporting layer 5 contains a binder resin. As the binder resin used for a photoreceptor applied to an image forming apparatus of particularly high resolution, in particularly, a polycarbonate resin represented by the general formula (IV) selected to have a viscosity average molecular weight of from 35,000 to 85,000 is preferable:

(IV)

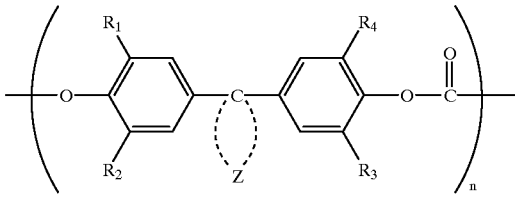

wherein R1 to R4 each represent a hydrogen atom, a halogen atom or an alkyl group having from 1 to 4 carbon atoms; and Z represents an atomic group for forming a substituted or unsubstituted carbon ring or a substituted or unsubstituted heterocycle.

The binder resin is not limited to the polycarbonate resin described in the foregoing, and a vinyl polymer, such as polymethyl methacrylate, polystyrene and polyvinyl chloride, a copolymer thereof, polyester, polyester carbonate, polysulfone, phenoxy, epoxy and silicone resin can be exemplified, which may be used singly or in combination of two or more of them. Furthermore, a copolymer of monomers required for forming the polymers and a thermosetting resin obtained by partial crosslinking may also be used.

A coating composition for forming the charge transporting layer 5 contains a solvent in addition to the charge transporting substance 5*a* and the binder resin. Examples of the solvent include a halogen series solvent, such as dichloromethane and 1,2-dichloroethane, a ketone series solvent, such as acetone, methyl ethyl ketone and cyclohexanone, an ester series solvent, such as ethyl acetate and butyl acetate, an ether series solvent, such as tetrahydrofuran and dioxane, an aromatic hydrocarbon series solvent, such as benzene, toluene and xylene, and a non-protonic solvent, such as N,N-dimethylformamide and dimethylsulfoxide.

The charge transporting layer 5 is produced, for example, in the following manner. A charge transporting substance 5*a* is dissolved in a solvent, and a binder resin is added thereto to obtain a coating composition. The charge transporting layer 5 is formed with the coating composition thus obtained by a coating method, such as a baker applicator, a barcoater, casting or spin coating, in the case of a sheet form. In the case of a drum form, the charge transporting layer 5 is formed by a spray method, a vertical ring method or a dip coating method.

The thickness of the charge transporting layer 5 is selected from the range of from 5 to 40 $\mu$m, and preferably from the range of from 10 to 30 $\mu$m. In the photoreceptor applied to the image forming apparatus of a particularly high resolution, the thickness of the charge transporting layer 5 is selected from the range of from 10 to 20 $\mu$m, and preferably from the range of from 10 to 17 $\mu$m.

As the intermediate layer 6, an inorganic layer, such as an anodic oxidized film of aluminum, aluminum oxide, aluminum hydroxide and titanium oxide, may be used. An organic film, such as polyvinyl alcohol, polyvinyl butyral, polyvinyl pyrrolidone, polyacrylic acid, a cellulose, gelatin, starch, polyurethane, polyimide, polyamide, casein and N-methoxymethylated nylon, may also be used. Furthermore, particles of titanium oxide, tin oxide or aluminum oxide may be dispersed in the layers. In particular, an intermediate layer 6 comprising, as main components, rutile type titanium oxide and a polyamide resin is preferable, and it is also preferable that the rutile type titanium oxide crystal is contained in an amount of from 30 to 50% by weight based on the total weight of the intermediate layer 6. In this case, excellent stability in the potential characteristics can be obtained, and the effect of preventing image defects is improved.

The provision of the intermediate layer 6 is preferable from the standpoint of production of the photoreceptor 7. That is, in the case where the charge generating layer 4 is formed on the conductive support 2 by a dip coating method, the coating composition for a charge generating layer is liable to be influenced by the heat capacity of the conductive support 2 due to the evaporation latent heat of the solvent. The influence can be relaxed by the intermediate layer 6.

The charge generating layer 4 and the charge transporting layer 5 may contain various additives, such as a leveling agent, an antioxidant and a sensitizer, depending on necessity. As the antioxidant, a hindered phenol is preferably contained in the charge transporting layer 5 of a photoreceptor applied to an image forming apparatus of high resolution. By using hindered phenol, excellent stability in the potential characteristics can be obtained. The hindered phenol is more preferably added in an amount of from 0.5 to 10% by weight based on the charge transporting substance 5*a*.

The additives are not limited to the hindered phenol, and vitamin E, hydroquinone, hindered amine, paraphenylene diamine, arylalkane, a derivative of these, an organic sulfur compound and an organic phosphorous compound may be used.

The invention will be specifically described with reference to the following Production Examples and Examples, but the invention is not construed as being limited to the Production Examples and Examples as far as it deviates the substance thereof.

Production Example 1

40 g of o-phthalodinitrile, 18 g of titanium tetrachloride, 500 ml of $\alpha$-chloronaphthalene were reacted by heating and stirring at 200 to 250° C. for 3 hours in a nitrogen atmosphere, and after standing to cool to a temperature of from 100 to 130° C., the mixture was filtered under hot. The reaction product was washed with 200 ml of $\alpha$-chloronaphthalene heated to 100° C. to obtain a crude product of dichlorotitanium phthalocyanine. The crude product was washed with 200 ml of a-chloronaphthalene at room temperature, and after further washing with 200 ml of methanol, the crude product was further washed by suspending under heating in 500 ml of methanol for 1 hour. After filtration, the resulting crude product was dissolved by stirring in 100 ml of concentrated sulfuric acid, and insoluble matters were removed by filtration. The sulfuric acid solution was poured into 3,000 ml of water, and deposited crystals were filtered. The crystals were repeatedly washed by suspending under heating in 500 ml of water until pH became 6 to 7, and then filtered to obtain a wet cake. The wet cake was treated with monochlorobenzene, and the subjected to a methanol treatment and then a cyclohexane treatment, followed by drying to obtain a first crystalline substance.

Figure 2:
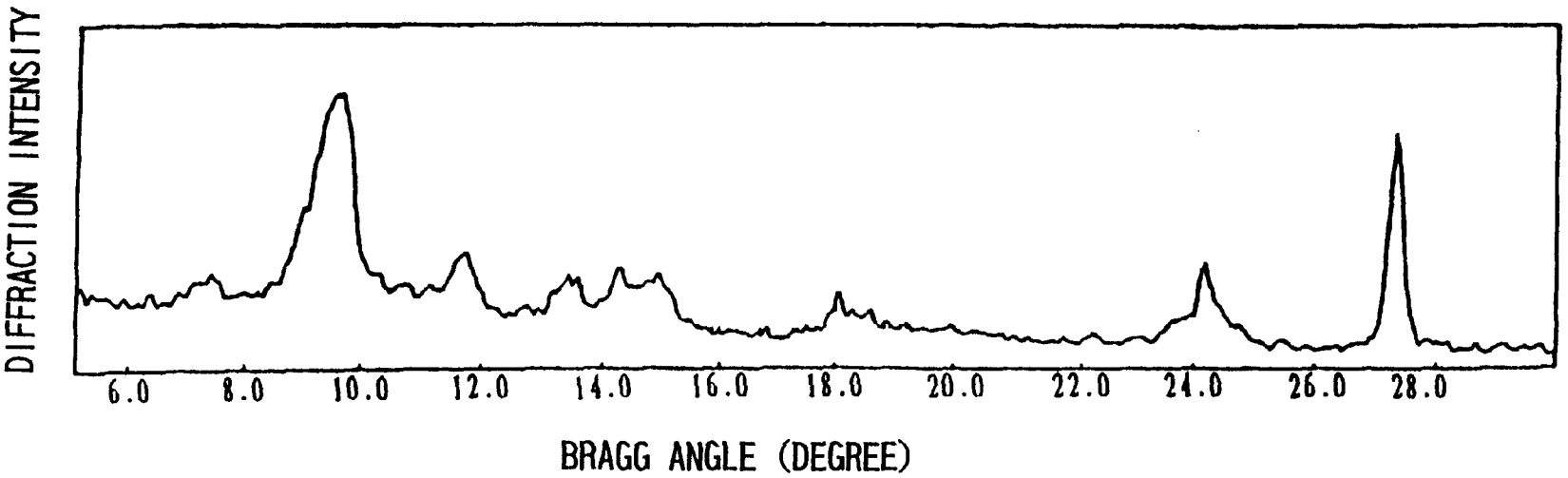
FIG. 2 is a graph showing an X-ray diffraction spectrum of a crystalline substance obtained in Production Example 1.

FIG. 2 is a graph showing an X-ray diffraction spectrum of the first crystalline substance. The measurement conditions of the X-ray diffraction spectrum are as follows.

| | |
|---|---|
| X-ray source: | CuKα = 1.5418 Å |
| Voltage: | 30 to 40 kV |
| Electric current: | 50 mA |
| Start angle: | 5.0° |
| Stop angle: | 30.0° |
| Step angle: | 0.01 to 0.02° |
| Measurement time: | 2.0 to 0.5° per min |
| Measurement method: | θ/2θ scanning method |

It can be understood from the X-ray diffraction spectrum that the resulting first crystalline substance is the crystalline titanyl phthalocyanine of the invention. Particularly, it has been found that the first crystalline substance is a crystalline titanyl phthalocyanine composition exhibiting, in the X-ray diffraction spectrum of a CuKα characteristic X-ray (wavelength: 1.5418 Å), at least four strong diffraction peaks in the low angle side of Bragg angles (2θ±0.2°) of 10.0° or lower, and a diffraction peak at a Bragg angle of 27.2°, where the maximum diffraction intensity of the four strong diffraction peaks at Bragg angles of 10.0° or lower is larger than the diffraction peak intensity at a Bragg angle of 27.2°. It has been also found that the first crystalline substance is a crystalline titanyl phthalocyanine composition, in which the diffraction peak intensity at a Bragg angle of 27.2° is in a range of from 40 to 80% of the maximum diffraction intensity of the four strong diffraction peaks at Bragg angles of 10.0° or lower. It has been also found that the first crystalline substance is a crystalline titanyl phthalocyanine composition, in which the four strong diffraction peaks at Bragg angles of 10.0° or lower are present at Bragg angles of 7.3°, 9.0°, 9.4° and 9.6°, respectively, and the diffraction peak at a Bragg angle of 9.4° is the diffraction peak having the maximum diffraction intensity among the diffraction peaks.

Production Example 2

A wet cake obtained in the same manner as in Production Example 1 was treated with monochlorobenzene and then treated with methanol, followed by drying. Crystals obtained by drying was subjected to a milling treatment in methyl ethyl ketone along with glass beads having a diameter of 1 mm in a paint conditioner apparatus (produced by Red Level Corp.), so as to obtain a second crystalline substance.

Figure 3:
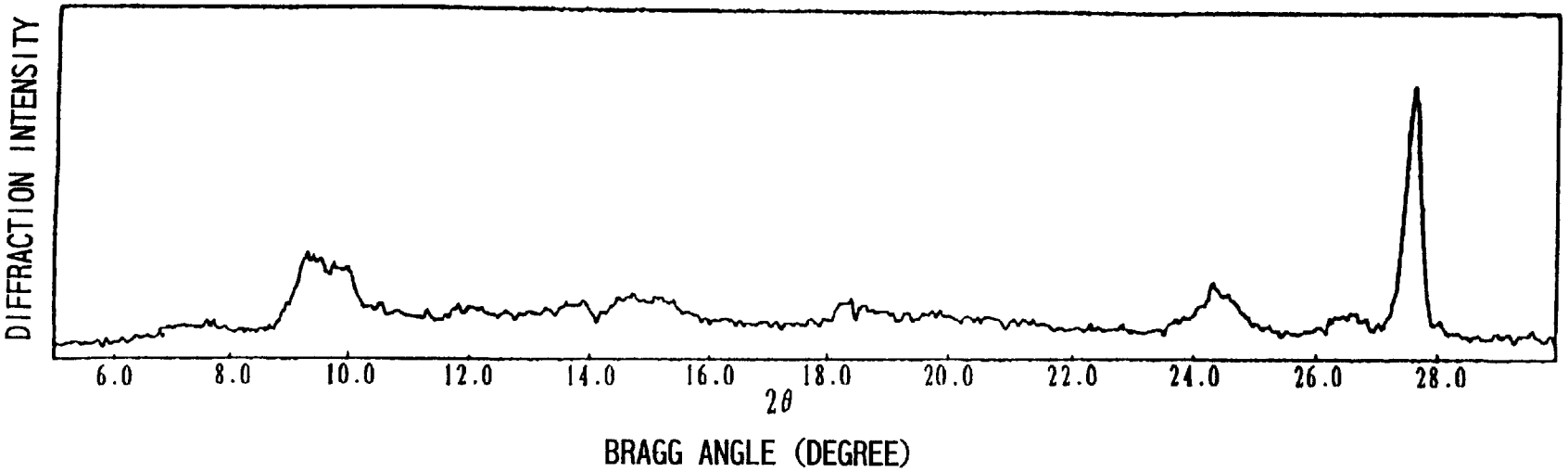
FIG. 3 is a graph showing an X-ray diffraction spectrum of a crystalline substance obtained in Production Example 2.

FIG. 3 is a graph showing an X-ray diffraction spectrum of the resulting second crystalline substance. The measurement conditions of the X-ray diffraction spectrum are the same as Production Example 1.

| | |
|---|---|
| X-ray source: | CuKα = 1.5418 Å |
| Voltage: | 30 to 40 kV |
| Electric current: | 50 mA |
| Start angle: | 5.0° |
| Stop angle: | 30.0° |
| Step angle: | 0.01 to 0.02° |
| Measurement time: | 2.0 to 0.5° per min |
| Measurement method: | θ/2θ scanning method |

It can be understood from the X-ray diffraction spectrum that the resulting second crystalline substance is the second lowly crystalline titanyl phthalocyanine of the invention. Particularly, it has been found that the second crystalline substance is a lowly crystalline titanyl phthalocyanine composition a diffraction peak having the maximum diffraction intensity at a Bragg angle (2θ±0.2°) of 27.3° in an X-ray diffraction spectrum of a CuKα characteristic X-ray (wavelength: 1.5418 Å). It has been also found that the second crystalline substance is a lowly crystalline titanyl phthalocyanine composition exhibiting plural diffraction peaks at Bragg angles of from 9.0 to 10.0°, and a diffraction peak at a Bragg angle of 24.0° that is broader than the diffraction peak at a Bragg angle of 27.3°. It has been also found that the second crystalline substance is a lowly crystalline titanyl phthalocyanine composition, in which the plural diffraction peaks present at a Bragg angle of from 9.0 to 10.0° and the diffraction peak present at a Bragg angle of 24.0° have diffraction intensities of 25% or less of the diffraction peak present at a Bragg angle of 27.3°, and contain a diffraction peak indicating an amorphous pattern. It has been also found that the second crystalline substance is a lowly crystalline titanyl phthalocyanine composition, in which at least one of the plural diffraction peaks present at a Bragg angle of from 9.0 to 10.0° is present at a Bragg angle of 9.1°, 9.3° or 9.50.

Comparative Production Example 1

After obtaining a crude product of dichlorotitanium phthalocyanine in the same manner as in Production Example 1, the crude product was washed with 200 ml of α-chloronaphthalene at room temperature, and after further washed with 200 ml of methanol, the crude product was washed by suspending under heating in 500 ml of methanol for 1 hour. After filtering, the resulting crude product was repeatedly washed by suspending under heating in 500 ml of water until pH became 6 to 7, followed by drying to obtain a crystalline substance of Comparative Production Example 1.

Figure 4:
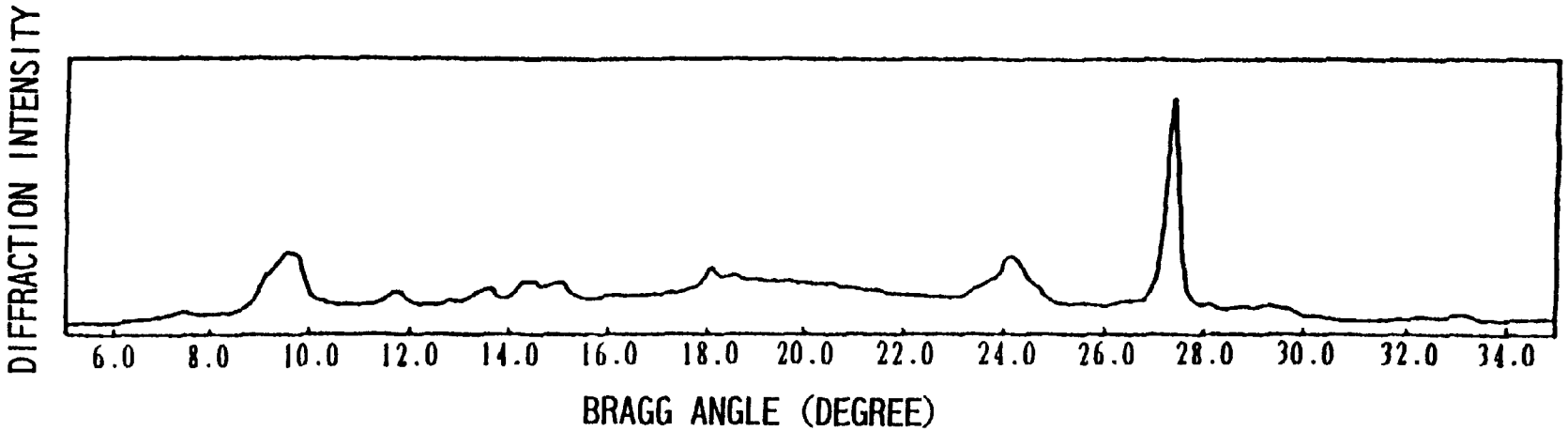
FIG. 4 is a graph showing an X-ray diffraction spectrum of a crystalline substance obtained in Comparative Production Example 1.

FIG. 4 is a graph showing an X-ray diffraction spectrum of the resulting crystalline substance. The measurement conditions of the X-ray diffraction spectrum were the same as those in Production Example 1. It can be understood that the resulting crystalline substance is classified to the Y-type titanyl phthalocyanine disclosed in Japanese Patent No. JP-C 1950255 (JP-B2 6-39575) exhibiting a diffraction peak having the maximum intensity at a Bragg angle (2θ±0.2°) of 27.3°.

Comparative Production Example 2

After obtaining a crude product of dichlorotitanium phthalocyanine in the same manner as in Production Example 1, the crude product was washed with 200 ml of α-chloronaphthalene at room temperature, and after further washed with 200 ml of methanol, the crude product was washed by suspending under heating in 500 ml of methanol for 1 hour. After filtering, the resulting crude product was repeatedly washed by suspending under heating in 500 ml of water until pH became 6 to 7. After drying, the crude product was again dissolved in sulfuric acid and then deposited in water, which was then treated with methanol, to obtain a crystalline substance of Comparative Production Example 2.

Figure 5:
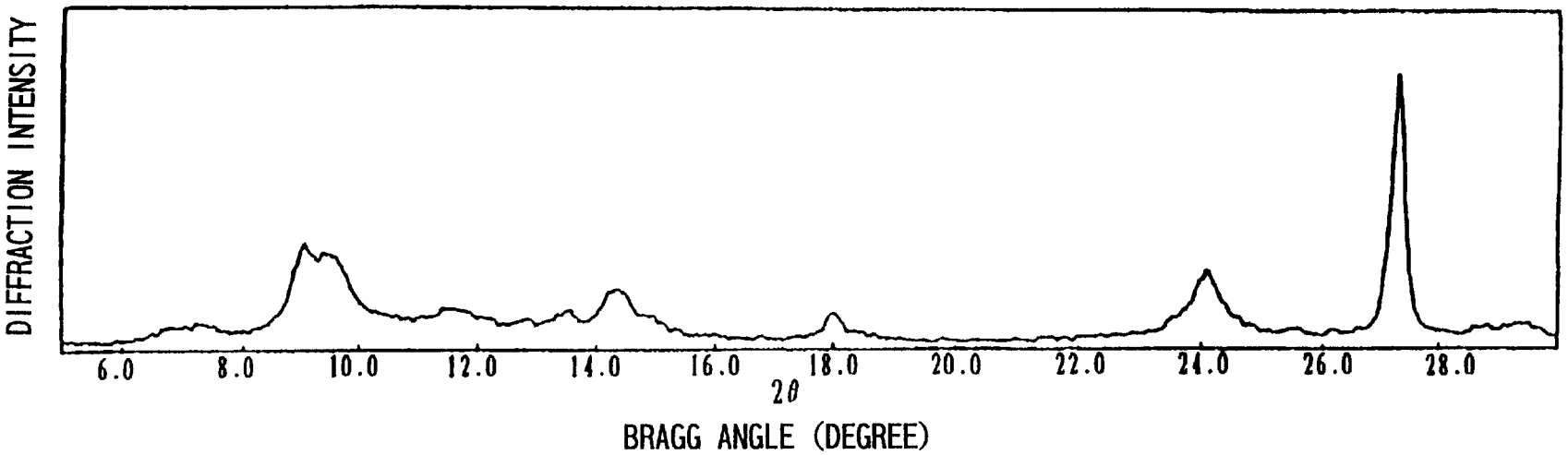
FIG. 5 is a graph showing an X-ray diffraction spectrum of a crystalline substance obtained in Comparative Production Example 2.

FIG. 5 is a graph showing an X-ray diffraction spectrum of the resulting crystalline substance. The measurement conditions of the X-ray diffraction spectrum were the same as those in Production Example 1. It can be understood that the resulting crystalline substance is classified to the I-type titanyl phthalocyanine disclosed in Japanese Examined Patent Pulication JP-B2 2502404 exhibiting a diffraction peak having the maximum intensity at a Bragg angle (2θ±0.2°) of 27.3°, and having a diffraction peak at a Bragg angles of 9.0°, 14.3° and 24.1°.

EXAMPLE 1

1 part by weight of the first crystalline titanyl phthalocyanine of the invention obtained in Production Example 1

(charge generating substance) and 1 part by weight of a butyral resin (binder resin) (Essrec BX-1 produced by Sekisui Chemical Co., Ltd., butyralation degree: 67±3% by mol) were mixed with 70 parts by weight of methyl ethyl ketone, and then subjected to a dispersion treatment with glass beads having a diameter of 2 mm in a paint conditioner apparatus (produced by Red Level Corp.), so as to prepare a coating composition for a charge generating layer. The resulting coating composition was coated on a conductive support 2 comprising a polyester film having an aluminum film vapor-deposited thereon, and then dried to form a charge generating layer 4 having a thickness of 0.4 μm. An X-ray diffraction spectrum of a dried matter of the coating composition for a charge generating layer was the same as the X-ray diffraction spectrum shown in FIG. 2.

A bisamine compound (charge transporting substance) shown by Example Compound No. 1 and a polycarbonate resin (binder resin) (C-1400 produced by Teijin Chemicals, Ltd., viscosity average molecular weight: 38,000) were mixed at a ratio of 1/1, and a coating composition for a charge transporting layer of a concentration of 18% by weight was prepared by using dichloromethane as a solvent. The resulting coating composition was coated on the charge generating layer 4, and then dried to form a charge transporting layer 5 having a thickness of 24 μm.

The thus produced photoreceptor 1 was evaluated for sensitivity by using a testing apparatus for charge recording paper (EPA-8200 produced by Kawaguchi Electric Works Co., Ltd.), and as a result, an extremely high sensitivity was obtained as a half-value exposure energy value of 0.10 $\mu J/cm^2$ (wavelength: 780 nm, exposure intensity: 2.0 $\mu W/cm^2$) required for optically decreasing the surface potential from −500 V to −250 V. A photoreceptor having such a sensitivity can be applied to a high-speed machine.

EXAMPLES 2 and 3

Photoreceptors 1 were produced in the same manner as in Example 1 except that bisamine compounds shown by Example Compound Nos. 11 and 14 were used instead of the bisamine compound used in Example 1. An extremely high sensitivity was obtained as the half-value exposure energy value was 0.09 $\mu J/cm^2$ for Example Compound No. 11 and 0.08 $\mu J/cm^2$for Example Compound No. 14.

EXAMPLE 4

A photoreceptor 1 was produced in the same manner as in Example 1 except that a butyral resin (Essrec BL-1 produced by Sekisui Chemical Co., Ltd., butyralation degree : 63±3% by mol) was used as a binder resin of the charge generating layer 4. As a result of the evaluation of the sensitivity in the same manner as in Example 1, an extremely high sensitivity was obtained as the half-value exposure energy value was 0.07 $\mu J/cm^2$.

EXAMPLE 5

A photoreceptor 1 was produced in the same manner as in Example 1 except that a vinyl chloride-vinyl acetate copolymer resin (SOLBINM produced by Nissin Chemical Co., Ltd.) was used as a binder resin of the charge generating layer 4. As a result of the evaluation of the sensitivity in the same manner as in Example 1, an extremely high sensitivity was obtained as the half-value exposure energy value was 0.05 $\mu J/cm^2$.

EXAMPLE 6

71.6 parts by weight of titanium oxide (STR-60N produced by Sakai Chemical Industry Co., Ltd.) and 107.4 parts by weight of a copolymer nylon (Amilan CM-8000 produced by Toray Industries, Inc.) were added to a mixed solvent comprising 287 parts by weight of methyl alcohol and 533 parts by weight of 1,2-dichloroethane, and then subjected to a dispersion treatment in a paint shaker for 8 hours, so as to prepare a coating composition for an intermediate layer. A cylindrical conductive support 2 comprising aluminum having a diameter of 65 mm and a length of 332 mm was dipped in the coating composition, and then dried to form an intermediate layer 6 having a thickness of 1 μm on the conductive support 2. The titanium oxide used in this example was surface-non-treated acicular rutile type titanium oxide. It was considered that the solvent of the coating composition for an intermediate layer was completely evaporated by drying.

3 parts by weight of the first crystalline titanyl phthalocyanine of the invention obtained in Production Example 1 (charge generating substance) and 1 part by weight of a butyral resin (binder resin) (Essrec BL-1 produced by Sekisui Chemical Co., Ltd., butyralation degree: 63±3% by mol) were mixed with 70 parts by weight of methyl ethyl ketone, and then subjected to a dispersion treatment in a paint shaker, so as to prepare a coating composition for a charge generating layer. The conductive support 2 having the intermediate layer 6 formed thereon was dipped in the resulting coating composition, and then dried to form a charge generating layer 4 having a thickness of 0.3 μm. The charge generating layer 4 formed on the intermediate layer 6 was substantially uniform.

A bisamine compound (charge transporting substance) shown by Example Compound No. 2 and a polycarbonate resin (binder resin) (PCZ-400 produced by Mitsubishi Gas Chemical Company, Inc., viscosity average molecular weight: 40,000) were mixed at a ratio of 1/1, to which α-tocopherol as one of a hindered phenol was further added in an amount of 2% by weight based on the polycarbonate resin, and a coating composition for a charge transporting layer of a concentration of 15% by weight was prepared by using dichloromethane as a solvent. The conductive support 2 forming a charge generating layer 4 was dipped in the resulting coating composition, and then dried to form a charge transporting layer 5 having a thickness of 15 μm. Thus, a cylindrical photoreceptor 7 having the intermediate layer 6 was obtained.

A photoreceptor of a sheet form having the same layer constitution was separately produced, and was evaluated for sensitivity by using the testing apparatus for charge recording paper. As a result, an extremely high sensitivity was obtained as the half-value exposure energy value was 0.06 $\mu J/cm^2$. The cylindrical photoreceptor 7 was installed in a commercial duplicator (AR5130 produced by Sharp Corp.). The resolution of the optical system of the duplicator was modified to conduct recording with an intermediate potential at a recording density of 1,500 dpi by a pulse width modulation method while the original recording light source was used, and a duplicated image was evaluated by using a polymer toner having an average particle diameter of 5.5 μm. As a result, density unevenness was not observed in an intermediate density, and such a resolution was obtained that a test pattern for testing resolution of 16 lines per millimeter could be distinguished. A clear image without fogging in a white background and minute black spots was obtained. There was no problem caused even after conducting duplication corresponding to 40,000 sheets. The thickness of the photosensitive layer 3 was measured after the duplication, and it was only decreased by 1.3 μm. Thus, it was found that the photoreceptor was excellent in printing durability.

EXAMPLE 7

Two parts by weight of the first crystalline titanyl phthalocyanine of the invention obtained in Production Example 1 (charge generating substance) and 1 part by weight of a butyral resin (binder resin) (Essrec BM-1 produced by Sekisui Chemical Co., Ltd., butyralation degree: 65±3% by mol) were mixed with 70 parts by weight of methyl ethyl ketone, and then subjected to a dispersion treatment in a paint shaker, so as to prepare a coating composition for a charge generating layer. The resulting coating composition is applied to the intermediate layer 6 by dipping as the same in Example 6, and then dried to form a charge generating layer 4 having a thickness of 0.3 μm. The charge generating layer 4 formed on the intermediate layer 6 was substantially uniform.

2,6-di-t-butyl-4-methylphenol (antioxidant) as one of a hindered phenol was added to the bisamine compound shown by Example Compound No. 3 (charge transporting substance) in an amount of 5% by weight to prepare a coating composition for a charge transporting layer. The coating composition was coated on the charge generating layer 4, and then dried to form a charge transporting layer 5 having a thickness of 14 μm. Thus, a cylindrical photoreceptor 7 having the intermediate layer 6 was obtained.

The sensitivity was evaluated in the same manner as in Example 6, and as a result, an extremely high sensitivity was obtained as the half-value exposure energy value was 0.06 $\mu J/cm^2$. The duplicated image was evaluated in the same manner as in Example 6. As a result, such a resolution was obtained that a test pattern for testing resolution of 16 lines per millimeter could be distinguished, and a clear image without fogging in a white background and minute black spots was obtained.

EXAMPLE 8

A photoreceptor 1 was produced in the same manner as in Example 6 except that an intermediate layer 6 was not provided. As a result of evaluation of sensitivity in the same manner as in Example 6, an extremely high sensitivity was obtained as the half-value exposure energy value was 0.07 $\mu J/cm^2$. However, there were cases where a slightly uneven coated film was obtained on coating the coating composition for a charge generating layer, and there were cases where dots and minute black spots were observed in the duplicated image. It was found that the photoreceptor was slightly inferior in production yield.

EXAMPLE 9

The titanium oxide used for the intermediate layer 6 in Example 6 (STR-60N produced by Sakai Chemical Industry Co., Ltd.) was surface-non-treated acicular rutile type titanium oxide. In Example 9, surface-non-treated granular rutile type titanium oxide (TTO-55N produced by Ishihara Sangyo Kaisha, Ltd.) was used instead of the titanium oxide used in Example 6, and 90 parts by weight of the titanium oxide and 90 parts by weight of copolymer nylon (Amilan CM-8000 produced by Toray Industries, Inc.) were used. The thickness of the charge transporting layer was 16 μm. The other conditions were the same as in Example 6, whereby a cylindrical photoreceptor 7 was produced.

As a result of evaluation of sensitivity in the same manner as in Example 6, an extremely high sensitivity was obtained as the half-value exposure energy value was 0. 10 $\mu J/cm^2$. As a result of evaluation of the duplicated image in the same manner as in Example 6, such a resolution was obtained that a test pattern for testing resolution of 16 lines per millimeter could be distinguished, and a clear image without fogging in a white background and minute black spots was obtained.

Comparative Example 1

A photoreceptor 1 was produced in the same manner as in Example 1 except that the titanyl phthalocyanine obtained in Comparative Production Example 1 was used. As a result of evaluation of sensitivity in the same manner as in Example 1, the half-value exposure energy value was 0.42 $\mu J/cm^2$. When the crystalline form of the titanyl phthalocyanine in the coating composition for a charge generating layer was examined by a X-ray diffraction pattern, it was found that it was converted to a crystalline form classified to the so-called β-type.

Comparative Example 2

A photoreceptor 1 was produced in the same manner as in Example 1 except that a butadiene compound represented by a structural formula (VI) was used as a charge transporting substance. As a result of evaluation of sensitivity in the same manner as in Example 1, the half-value exposure energy value was 0.21 $\mu J/cm^2$, and thus such high sensitivity characteristics as in Example 1 could not be obtained.

(VI)

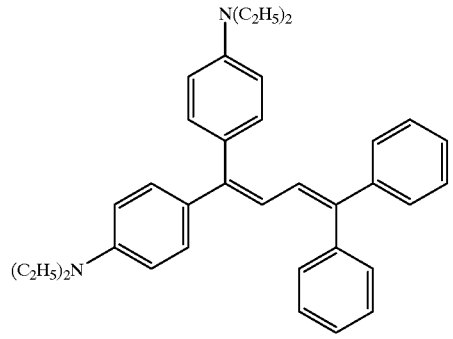

Comparative Example 3

A photoreceptor 1 was produced in the same manner as in Example 1 except that a dimer of triphenylamine represented by a structural formula (VII) was used as a charge transporting substance. As a result of evaluation of sensitivity in the same manner as in Example 1, the half-value exposure energy value was 0.25 $\mu J/cm^2$, and thus such high sensitivity characteristics as in Example 1 could not be obtained.

(VII)

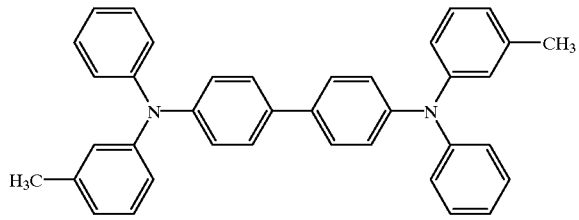

Comparative Example 4

A photoreceptor 1 was produced in the same manner as in Example 1 except that a styryl compound represented by a structural formula (VIII) was used as a charge transporting substance. As a result of evaluation of sensitivity in the same manner as in Example 1, the half-value exposure energy value was 0.22 $\mu J/cm^2$, and thus such high sensitivity characteristics as in Example 1 could not be obtained.

(VIII)

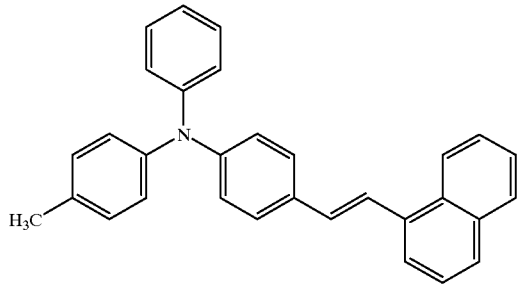

Comparative Example 5

A photoreceptor 1 was produced in the same manner as in Example 1 except that a hydrazone compound represented by a structural formula (IX) was used as a charge transporting substance. As a result of evaluation of sensitivity in the same manner as in Example 1, the half-value exposure energy value was 0.25 $\mu J/cm^2$, and thus such high sensitivity characteristics as in Example 1 could not be obtained.

(IX)

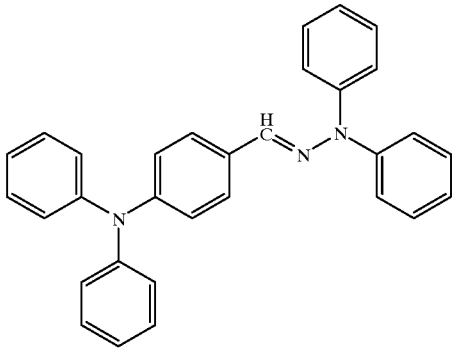

Comparative Example 6

A photoreceptor 7 was produced in the same manner as in Example 6 except that the thickness of the charge generating layer 5 was changed to 28 $\mu m$. As a result of the evaluation of the sensitivity in the same manner as in Example 6, an extremely high sensitivity was obtained as the half-value exposure energy value was 0.04 $\mu J/cm^2$. However, as a result of evaluation of the duplicated image using a polymer toner having an average diameter of 5.5 $\mu m$ in the same manner as in Example 6, such a low resolution was obtained that a test pattern for testing resolution of 10 lines per millimeter could be distinguished, but such a high resolution in Example 6 that a test pattern for testing resolution of 16 lines per millimeter could be distinguished could not be obtained.

Comparative Example 7

A photoreceptor 7 was produced in the same manner as in Example 6 except that αtocopherol (antioxidant) was not added. As a result of evaluation of the sensitivity in the same manner as in Example 6, an extremely high sensitivity was obtained as the half-value exposure energy value was 0.06 $\mu J/cm^2$. As a result of evaluation of the image in the same manner as in Examples, such a high resolution was obtained that a test pattern for testing resolution of 16 lines per millimeter could be distinguished. However, there was a problem in durability that the charge potential was deteriorated.

Comparative Example 8

120 parts by weight of titanium oxide (STR-60N produced by Sakai Chemical Industry Co., Ltd.) and 60 parts by weight of a copolymer nylon (Amilan CM-8000 produced by Toray Industries, Inc.) were added to a mixed solvent comprising 287 parts by weight of methyl alcohol and 533 parts by weight of 1,2-dichloroethane to prepare a coating composition for an intermediate layer. A photoreceptor 7 was produced in the same manner as in Example 6 except that the intermediate layer 6 was formed by using the coating composition for an intermediate layer prepared in this example. As a result of evaluation of the sensitivity in the same manner as in Example 6, high sensitivity was obtained as the half-value exposure energy value was 0.07 $\mu J/cm^2$. However, as a result of evaluation of the image in the same manner as in Example 6, an image of high quality could not be obtained but many minute black spots were formed on the white background of the image.

Comparative Example 9

A photoreceptor 7 was produced in the same manner as in Example 6 except that a polycarbonate resin (C-1400 produced by Teijin Chemicals, Ltd.) was used as the binder resin in the charge transporting layer 5. As a result of evaluation of the sensitivity in the same manner as in Example 6, high sensitivity was obtained as the half-value exposure energy value was 0.07 $\mu J/cm^2$. As a result of evaluation of the image in the same manner as in Example 6, such a resolution was obtained that a test pattern for testing resolution of 16 lines per millimeter could be distinguished. However, it was found that there was a problem in that the decrease in charge property after duplication corresponding to 40,000 sheets was large in comparison to Example 6. The decrease in potential was ascribed to the decrease in the thickness of the photosensitive layer, and the thickness was decreased by 5.3 $\mu m$.

EXAMPLE 11

A charge generating layer 4 having a thickness of 0.4 $\mu m$ was formed in the same manner as in Example 1 except that 2 parts by weight of the second lowly crystalline titanyl phthalocyanine of the invention obtained in Production Example 2 was used as the charge generating substance.

A charge transporting layer 5 having a thickness of 22 $\mu m$ was formed on the charge generating layer 4 by coating a coating composition for a charge transporting layer prepared in the same manner as in Example 1.

As a result of evaluation of the sensitivity of the photoreceptor 1thus produced by using a testing apparatus for charge recording paper (EPA-8200 produced by Kawaguchi Electric Works Co., Ltd.) in the same manner as in Example 1, an extremely high sensitivity was obtained as a half-value exposure energy value of 0.04 $\mu J/cm^2$ (wavelength: 780 nm, exposure intensity: 2.0 $\mu W/cm^2$) required for optically decreasing the surface potential from −500 V to −250 V. A photoreceptor having such a sensitivity can be applied to a high-speed machine.

EXAMPLES 12 and 13

Photoreceptors 1 were produced in the same manner as in Example 1 except that the second lowly crystalline titanyl phthalocyanine of the invention obtained in Production Example 2 was used as the charge generating substance and bisamine compounds shown by Example Compound Nos. 11 and 14 were used instead of the bisamine compound used in Example 1. An extremely high sensitivity was obtained as the half-value exposure energy value was 0.09 $\mu J/cm^2$ for Example Compound No. 11 and 0.10 $\mu J/cm^2$ for Example Compound No. 14.

EXAMPLE 14

A charge generating layer 4 having a thickness of 0.5 $\mu m$ was formed in the same manner as in Example 6 except that 3 parts by weight of the second lowly crystalline titanyl phthalocyanine of the invention obtained in Production Example 2 was used as charge generating substance. The charge generating layer 4 formed on the intermediate layer 6 was substantially uniform.

In a coating composition for a charge transporting layer obtained in the same manner as in Example 6, the conductive support 2 forming a charge generating layer 4 was dipped in the resulting coating composition, and then dried to form a charge transporting layer 5 having a thickness of 15 $\mu m$. Thus, a cylindrical photoreceptor 7 having the intermediate layer 6 was obtained.

A photoreceptor of a sheet form having the same layer constitution was separately produced, and was evaluated for sensitivity by using the testing apparatus for charge recording paper in the same manner as in Example 6. As a result, an extremely high sensitivity was obtained as the half-value exposure energy value was 0.08 $\mu J/cm^2$. A duplicated image was evaluated by using the cylindrical photoreceptor 7 in the same manner as in Example 6. As a result, density unevenness was not observed in an intermediate density, and such a resolution was obtained that a test pattern for testing resolution of 16 lines per millimeter could be distinguished. A clear image without fogging in a white background and minute black spots was obtained. There was no problem caused even after conducting duplication corresponding to 40,000 sheets. The thickness of the photosensitive layer 3 was measured after the duplication, and it was only decreased by 1.9 $\mu m$. Thus, it was found that the photoreceptor was excellent in printing durability.

EXAMPLE 15

A charge generating layer 4 having a thickness of 0.4 $\mu m$ was formed in the same manner as in Example 7 except that 2 parts by weight of the second lowly crystalline titanyl phthalocyanine of the invention obtained in Production Example 2 (charge generating substance) was used. The charge generating layer 4 formed on the intermediate layer 6 was substantially uniform.

A coating composition for a charge transporting layer was prepared in the same manner as in Example 7 . The coating composition was coated on the charge generating layer 4, and then dried to form a charge transporting layer 5 having a thickness of 14 $\mu m$. Thus, a cylindrical photoreceptor 7 having the intermediate layer 6 was obtained.

The sensitivity was evaluated in the same manner as in Example 6, and as a result, an extremely high sensitivity was obtained as the half-value exposure energy value was 0.08 $\mu J/cm^2$. The duplicated image was evaluated in the same manner as in Example 6. As a result, such a resolution was obtained that a test pattern for testing resolution of 16 lines per millimeter could be distinguished, and a clear image without fogging in a white background and minute black spots was obtained.

EXAMPLE 16

A cylindrical photoreceptor 1 was produced in the same manner as in Example 14 except that an intermediate layer 6 was not provided. As a result of evaluation of sensitivity in the same manner as in Example 6, an extremely high sensitivity was obtained as the half-value exposure energy value was 0.07 $\mu J/cm^2$. However, there were cases where a slightly uneven coated film was obtained on coating the coating composition for a charge generating layer, and there were cases where dots and minute black spots were observed in the duplicated image. It was found that the photoreceptor was slightly inferior in production yield.

EXAMPLE 17

The titanium oxide used for the intermediate layer 6 in Example 14 (STR-60N produced by Sakai Chemical Industry Co., Ltd.) was surface-non-treated acicular rutile type titanium oxide. In Example 17 , surface-non-treated granular rutile type titanium oxide (TTO-55N produced by Ishihara Sangyo Kaisha, Ltd.) was used instead of the titanium oxide used in Example 14, and 90 parts by weight of the titanium oxide and 90 parts by weight of copolymer nylon (Amilan CM-8000 produced by Toray Industries, Inc.) were used. The thickness of the charge transporting layer was 16 $\mu m$. The other conditions were the same as in Example 14, whereby a cylindrical photoreceptor 7 was produced.

As a result of evaluation of sensitivity in the same manner as in Example 6, an extremely high sensitivity was obtained as the half-value exposure energy value was 0.08 $\mu J/cm^2$. As a result of evaluation of the duplicated image in the same manner as in Example 6, such a resolution was obtained that a test pattern for testing resolution of 16 lines per millimeter could be distinguished, and a clear image without fogging in a white background and minute black spots was obtained.

Comparative Example 11

A photoreceptor 1 was produced in the same manner as in Example 11 except that the titanyl phthalocyanine obtained in Comparative Production Example 2 was used. As a result of evaluation of the sensitivity in the same manner as in Example 11, the half-value exposure energy value was 0.45 $\mu J/cm^2$. When the crystalline form of the titanyl phthalocyanine in the coating composition for a charge generating layer was examined by a X-ray diffraction pattern, it was found that it was converted to a crystalline form classified to the so-called β-type.

Comparative Example 12

A photoreceptor 1 was produced in the same manner as in Example 11 except that a butadiene compound represented by the structural formula (VI) was used as a charge transporting substance. As a result of evaluation of sensitivity in the same manner as in Example 11, the half-value exposure energy value was 0.24 $\mu J/cm^2$, and thus such high sensitivity characteristics as in Example 1 could not be obtained.

Comparative Example 13

A photoreceptor 1 was produced in the same manner as in Example 11 except that a dimer of triphenylamine represented by the structural formula (VII) was used as a charge transporting substance. As a result of evaluation of sensitivity in the same manner as in Example 11, the half-value exposure energy value was 0.21 $\mu J/cm^2$, and thus such high sensitivity characteristics as in Example 11 could not be obtained.

Comparative Example 14

A photoreceptor 1 was produced in the same manner as in Example 11 except that a styryl compound represented by the structural formula (VIII) was used as a charge transporting substance. As a result of evaluation of sensitivity in the same manner as in Example 11, the half-value exposure energy value was 0.22 $\mu J/cm^2$, and thus such high sensitivity characteristics as in Example 11 could not be obtained.

Comparative Example 15

A photoreceptor 1 was produced in the same manner as in Example 11 except that a hydrazone compound represented by the structural formula (IX) was used as a charge transporting substance. As a result of evaluation of sensitivity in the same manner as in Example 11, the half-value exposure energy value was 0.28 $\mu J/cm^2$, and thus such high sensitivity characteristics as in Example 11 could not be obtained.

Comparative Example 16

A photoreceptor 7 was produced in the same manner as in Example 14 except that the thickness of the charge generating layer 5 was changed to 30 $\mu$m. As a result of the evaluation of the sensitivity in the same manner as in Example 14, an extremely high sensitivity was obtained as the half-value exposure energy value was 0.06 $\mu J/cm^2$. However, as a result of evaluation of the image in the same manner as in Example 14, such a low resolution was obtained that a test pattern for testing resolution of 10 lines per millimeter could be distinguished, but such a high resolution in Example 14 that a test pattern for testing resolution of 16 lines per millimeter could be distinguished could not be obtained.

Comparative Example 17

A photoreceptor 7 was produced in the same manner as in Example 14 except that $\alpha$-tocopherol (antioxidant) was not added. As a result of evaluation of the sensitivity in the same manner as in Example 14, an extremely high sensitivity was obtained as the half-value exposure energy value was 0.07 $\mu J/cm^2$. As a result of evaluation of the image in the same manner as in Example 14, such a high resolution was obtained that a test pattern for testing resolution of 16 lines per millimeter could be distinguished. However, there was a problem in durability that the charge potential was deteriorated.

Comparative Example 18

120 parts by weight of titanium oxide (STR-60N produced by Sakai Chemical Industry Co., Ltd.) and 60 parts by weight of a copolymer nylon (Amilan CM-8000 produced by Toray Industries, Inc.) were added to a mixed solvent comprising 287 parts by weight of methyl alcohol and 533 parts by weight of 1,2-dichloroethane to prepare a coating composition for an intermediate layer. A photoreceptor 7 was produced in the same manner as in Example 14 except that the intermediate layer 6 was formed by using the coating composition for an intermediate layer prepared in this example. As a result of evaluation of the sensitivity in the same manner as in Example 14, high sensitivity was obtained as the half-value exposure energy value was 0.08 $\mu J/cm^2$. However, as a result of evaluation of the image in the same manner as in Example 14, an image of high quality could not be obtained but many minute black spots were formed on the white background of the image.

Comparative Example 19

A photoreceptor 7 was produced in the same manner as in Example 14 except that a polycarbonate resin (C-1400 produced by Teijin Chemicals, Ltd.) was used as the binder resin in the charge transporting layer 5. As a result of evaluation of the sensitivity in the same manner as in Example 14, high sensitivity was obtained as the half-value exposure energy value was 0.08 $\mu J/cm^2$. As a result of evaluation of the image in the same manner as in Example 14, such a resolution was obtained that a test pattern for testing resolution of 16 lines per millimeter could be distinguished. However, it was found that there was a problem in that the decrease in charge property after duplication corresponding to 40,000 sheets was large in comparison to Example 14. The decrease in potential was ascribed to the decrease in the thickness of the photosensitive layer, and the thickness was decreased by 6.2 $\mu$m.

(Evaluation)

The photoreceptors of Examples 1 to 7 and 11 to 17 and Comparative Examples 1 to 9 and 11 to 19 were installed in a digital duplicator (modified AR5130 produced by Sharp Corp.), and continuous blank duplication (non-copy aging) was conducted 40,000 times, between which the initial charge potential $V_0$ (V) and the sensitivity (half-value exposure amount) ($\mu J/cm^2$) were evaluated. A change in light potential level under a low temperature and low humidity environment of 5° C./20%RH and a high temperature and high humidity environment of 35° C./80%RH (temperature characteristic change) $\Delta V_L$ (V) was measured. Furthermore, evaluation of the initial stability of the charge potential under a low temperature and low humidity environment, i.e., a decreasing amount of charge (V) of the first rotation of the cylindrical photoreceptor after dark adaptation was also measured.

The cylindrical photoreceptors were subjected to reverse development under high temperature and high humidity environment at a charge potential of −800 V, and minute image defects were evaluated as image characteristics of the resulting duplicated image. The resolution (lines per millimeter) was also measured. Furthermore, in some Examples and Comparative Examples, duplication corresponding to 40,000 sheets was conducted, and the durability of the photoreceptor was evaluated. The results of evaluations are shown in Tables 6 and 7 .

TABLE 6

| | Charge potential (V) | | Half-value exposure amount ($\mu J/cm^2$) | | Decrease in charge on | Image characteristics | Temperature | Resolution | |
|---|---|---|---|---|---|---|---|---|---|
| | Initial | After test | Initial | After test | 1st rotation (V) | minute image defects | characteristics change | (lines per millimeter) | Duplication durability |
| Example 1 | −505 | −488 | 0.10 | 0.11 | −29 | — | 30 | — | — |
| Example 2 | −497 | −481 | 0.09 | 0.11 | −30 | — | 25 | — | — |
| Example 3 | −501 | −491 | 0.08 | 0.10 | −28 | — | 40 | — | — |
| Example 4 | −499 | −481 | 0.07 | 0.08 | −31 | good | 31 | 16 | good |
| Example 5 | −503 | −488 | 0.05 | 0.07 | −29 | good | 35 | 16 | — |
| Example 6 | −490 | −469 | 0.06 | 0.07 | −32 | slightly poor | 51 | 16 | — |
| Example 7 | −502 | −484 | 0.06 | 0.09 | −38 | good | 29 | 16 | — |
| Comparative Example 1 | −482 | −465 | 0.42 | 0.52 | −102 | — | 68 | — | — |
| Comparative Example 2 | −499 | −468 | 0.21 | 0.23 | −55 | — | 35 | — | — |
| Comparative Example 3 | −488 | −466 | 0.25 | 0.27 | −68 | — | 49 | — | — |
| Comparative Example 4 | −480 | −447 | 0.22 | 0.26 | −72 | — | 56 | — | — |
| Comparative Example 5 | −495 | −461 | 0.25 | 0.25 | −88 | — | 69 | — | — |
| Comparative Example 6 | −501 | −474 | 0.04 | 0.05 | −45 | good | 35 | 10 | — |
| Comparative Example 7 | −480 | −434 | 0.06 | 0.08 | −55 | good | 90 | 16 | — |
| Comparative Example 8 | −497 | −470 | 0.07 | 0.10 | −99 | poor | 48 | 16 | — |
| Comparative Example 9 | −501 | −479 | 0.07 | 0.08 | −51 | good | 65 | 16 | poor |

TABLE 7

| | Charge potential (V) | | Half-value exposure amount ($\mu J/cm^2$) | | Decrease in charge on | Image characteristics | Temperature | Resolution | |
|---|---|---|---|---|---|---|---|---|---|
| | Initial | After test | Initial | After test | 1st rotation (V) | minute image defects | characteristics change | (lines per millimeter) | Duplication durability |
| Example 11 | −501 | −485 | 0.11 | 0.11 | −31 | — | 35 | — | — |
| Example 12 | −498 | −479 | 0.09 | 0.10 | −29 | — | 40 | — | — |
| Example 13 | −499 | −481 | 0.10 | 0.12 | −28 | — | 40 | — | — |
| Example 14 | −505 | −488 | 0.08 | 0.09 | −33 | good | 31 | 16 | good |
| Example 15 | −498 | −481 | 0.07 | 0.08 | −39 | good | 35 | 16 | — |
| Example 16 | −496 | −480 | 0.07 | 0.10 | −39 | slightly poor | 47 | 16 | — |
| Example 17 | −505 | −489 | 0.10 | 0.11 | −32 | good | 41 | 16 | — |
| Comparative Example 11 | −487 | −465 | 0.45 | 0.49 | −105 | — | 69 | — | — |
| Comparative Example 12 | −499 | −471 | 0.24 | 0.25 | −68 | — | 54 | — | — |
| Comparative Example 13 | −480 | −461 | 0.21 | 0.26 | −73 | — | 64 | — | — |
| Comparative Example 14 | −491 | −467 | 0.22 | 0.23 | −65 | — | 55 | — | — |
| Comparative Example 15 | −503 | −470 | 0.28 | 0.30 | −92 | — | 88 | — | — |
| Comparative Example 16 | −509 | −484 | 0.06 | 0.07 | −44 | good | 42 | 10 | — |
| Comparative Example 17 | −497 | −401 | 0.07 | 0.14 | −74 | good | 97 | 16 | — |
| Comparative Example 18 | −499 | −470 | 0.08 | 0.10 | −101 | poor | 65 | 16 | — |
| Comparative Example 19 | −500 | −439 | 0.08 | 0.15 | −39 | good | 48 | 16 | poor |

In the photoreceptor 1 and 7 having a charge generating layer 4 containing the first crystalline titanyl phthalocyanine composition of the invention as the charge generating substance as shown in Examples 1 to 7 , the initial sensitivity, i.e., the half-value exposure amount, is sufficiently high, and the decrease in charge on the first process after dark adaptation under a low temperature and low humidity condition is low, in comparison to a photoreceptor having a charge generating layer containing a titanyl phthalocyanine composition not encompassed in the invention as the charge generating substance as shown in Comparative Example 1.

Further, in the photoreceptor 1 and 7 having a charge generating layer 4 containing the first crystalline titanyl phthalocyanine composition of the invention as the charge generating substance 4*a* as shown in Examples 1 to 7 and the charge transporting layer 5 containing bisamine compounds as the charge transporting substance 5*a,* the initial sensitivity, i.e., the half-value exposure amount, is sufficiently high, in comparison to a photoreceptor having a charge transporting layer not containing the charge transporting substance of the invention as shown in Comparative Examples 2–5. Furthermore, the decrease in charge on the first process after dark adaptation under a low temperature and low humidity condition is low.

In the photoreceptor 7 having the intermediate layer 6 containing the rutile type titanium oxide and the polyamide, where the rutile type titanium oxide is contained in an amount of from 30 to 50% by weight based on the total weight of the intermediate layer 6, as shown in Example 6, minute image defects are not formed, and good image characteristics are obtained, in comparison to a photoreceptor, in which an intermediate layer contains titanium oxide in an amount of 50% by weight or more based on the total weight of the intermediate layer as shown in Comparative Example 8. Furthermore, the initial sensitivity is sufficiently high, and the decrease in charge on the first process after dark adaptation under a low temperature and low humidity condition is low.

In the photoreceptor 7 having the charge transporting layer 5 having a thickness selected from the range of from 10 to 20 $\mu$m as shown in Example 6, the resolution is excellent as 16 lines per millimeter are distinguished, in comparison to a photoreceptor having a charge transporting layer having a thickness of more than 20 $\mu$m as shown in Comparative Example 6.

In the photoreceptor 7 containing a hindered phenol, such as $\alpha$-tocopherol, as an antioxidant as shown in Example 6, it has been found that the decrease in charge on the first process after dark adaptation under a low temperature and low humidity condition is low, in comparison to a photoreceptor containing no antioxidant as shown in Comparative Example 7.

In the photoreceptor 1 and 7 having a charge generating layer 4 containing the second lowly crystalline titanyl phthalocyanine composition of the invention as the charge generating substance as shown in Examples 11 to 17 , the initial sensitivity, i.e., the half-value exposure amount, is sufficiently high, and the decrease in charge on the first process after dark adaptation under a low temperature and low humidity condition is low, in comparison to a photoreceptor having a charge generating layer containing a titanyl phthalocyanine composition not encompassed in the invention as the charge generating substance as shown in Comparative Example 11.

In the photoreceptor 1 and 7 having a charge generating layer 4 containing the second lowly crystalline titanyl phthalocyanine composition of the invention as the charge generating substance 4*a* as shown in Examples 11 to 17 , the initial sensitivity, i.e., the half-value exposure amount, is sufficiently high, and the decrease in charge on the first process after dark adaptation under a low temperature and low humidity condition is low, in comparison to a photoreceptor having a charge transporting layer not containing the charge transporting substance of the invention as shown in Comparative Examples 12 to 15.

In the photoreceptor 7 having the intermediate layer 6 between the conductive support 2 and the charge generating layer 4 as shown in Example 14, minute image defects are not formed, and good image characteristics are obtained, in comparison to a photoreceptor having no intermediate layer as shown in Example 16.

In the photoreceptor 7 having the intermediate layer 6 containing the rutile type titanium oxide and the polyamide, where the rutile type titanium oxide is contained in an amount of from 30 to 50% by weight based on the total weight of the intermediate layer 6, as shown in Example 14, minute image defects are not formed, and good image characteristics are obtained, in comparison to a photoreceptor, in which an intermediate layer contains titanium oxide in an amount of 50% by weight or more based on the total weight of the intermediate layer as shown in Comparative Example 18. Furthermore, the initial sensitivity is sufficiently high, and the decrease in charge on the first process after dark adaptation under a low temperature and low humidity condition is low.

In the photoreceptor 7 having the charge transporting layer 5 having a thickness selected from the range of from 10 to 20 $\mu$m as shown in Example 14, the resolution is excellent as 16 lines per millimeter are distinguished, in comparison to a photoreceptor having a charge transporting layer having a thickness of more than 20 $\mu$m as shown in Comparative Example 16.

In the photoreceptor 7 containing a hindered phenol, such as $\alpha$-tocopherol, as an antioxidant as shown in Example 14, it has been found that the decrease in charge on the first process after dark adaptation under a low temperature and low humidity condition is low, in comparison to a photoreceptor containing no antioxidant as shown in Comparative Example 17.

As described in the foregoing, the electrophotographic photoreceptor of the invention has such excellent characteristics that a process design can be realized where an image can be formed on the first image formation cycle, the change in potential characteristics depending on environmental change is small, a good image having no minute image defect is obtained, and the sensitivity is high. Therefore, the photoreceptor of the invention can be suitably applied to a laser printer and a digital duplicator using semiconductor laser as a light source. The coating composition for a charge generating layer of the invention can be suitably used for forming the photoreceptor.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electrophotographic photoreceptor comprising:

a conductive support; and a photosensitive layer having a layered structure comprising a charge generating layer and a charge transporting layer, the photosensitive layer being formed on the conductive support, the charge generating layer comprising a crystalline titanyl phthalocyanine composition as a charge generating substance, the charge transporting layer comprising a bisamine compound represented by a general formula (I) as a charge transporting substance, the crystalline titanyl phthalocyanine composition exhibiting at least four diffraction peaks at Bragg angles (2θ±0.2°) of 10.0° or lower and a diffraction peak at a Bragg angle of 27.2°, a maximum diffraction intensity of the four diffraction peaks at Bragg angles of 10.0° or lower being larger than the diffraction peak intensity at a Bragg angle of 27.2° in an X-ray diffraction spectrum of a Cukα characteristic X-ray (Wavelength: 1.5418 Å)

(I)

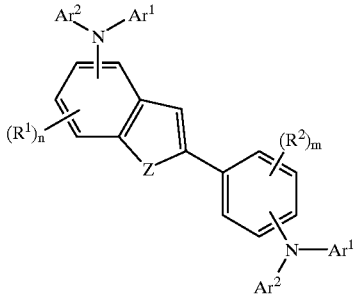

wherein $Ar^1$ and $Ar^2$ each represent an aryl group, which may have a substituent, a heterocyclic group, which may have a substituent, an aralkyl group, which may have a substituent, or an alkyl group substituted with a heterocyclic group, which may have a .substituent; Z represents an atom of O, S or Se; $R^1$ and $R^2$ each represent an alkyl, alkoxy or dialkylamino group having from 1 to 3 carbon atoms, which may have a substituent, or a halogen atom or a hydrogen atom; m represents an integer of from 1 to 4; and n represents an integer of from 1 to 3, provided that when m and n are 2 or more, $R^1$ and $R^2$ may be the same as or different from each other, and may form a ring.

2. The electrophotographic photoreceptor of claim 1, wherein the charge generating layer further comprises a polyvinyl butyral resin having a butyralation degree of 50% by mol or more and less than 70% by mol.

3. The electrophotographic photoreceptor of claim 1, wherein the charge generating layer further comprises a polymer of a vinyl compound or a copolymer of a vinyl compound.

4. The electrophotographic photoreceptor of claim 1, wherein the diffraction peak intensity at a Bragg angle of 27.2° is from 40% to 80% of the maximum diffraction intensity of the four diffraction peaks at Bragg angles of 10.0° or lower.

5. The electrophotographic photoreceptor of claim 1, wherein at least one of the four diffraction peaks at Bragg angles of 10.0° or lower is present at a Bragg angle of 7.3°, 9.0°, 9.3°, 9.5° or 9.7°.

6. The electrophotographic photoreceptor of claim 1, wherein the bisamine compound represented by the general formula (I) is represented by a general formula (II):

(II)

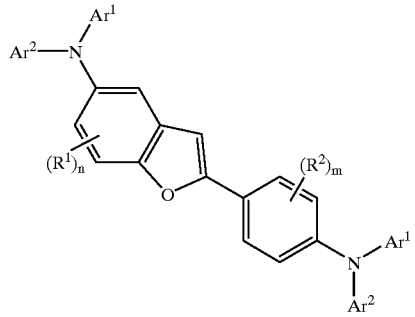

wherein $Ar^1$ and $Ar^2$ each represent an aryl group, heterocyclic, group, which may have a substituent, an aralkyl group, which may have a substituent, or an alkyl group substituted with a heterocyclic group, which may have a substituent; $R^1$ and $R^2$ each represent an alkyl, alkoxy or dialkylamino group having from 1 to 3 carbon atoms, which may have a substituent, or a halogen atom or a hydrogen atom; m represents an integer of from 1 to 4; and n represents an integer of from 1 to 3, provided that when m and n are 2 or more, $R^1$ and $R^2$ may be the same as or different from each other, and may form a ring.

7. The electrophotographic photoreceptor of claim 6, wherein the bisamine compound represented by the general formula (II) is represented by a general formula (III):

(III)

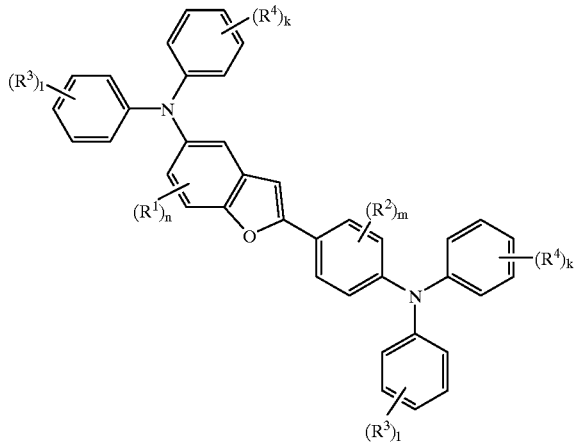

wherein $R^1$ and $R^2$ each represent an alkyl, alkoxy or dialkylamino group having from 1 to 3 carbon atoms, which may have a substituent, or a halogen atom or a hydrogen atom; $R^3$ and $R^4$ each represent an alkyl group, which may have a substituent, an alkoxy group, which may have a substituent, a dialkylamino group, which may have a substituent, or a hydrogen atom; m represents an integer of from 1 to 4; and n, l and k each represent an integer of from 1 to 3, provided that when m and n are 2 or more, $R^1$ and $R^2$ may be the same as or different from each other, and may form a ring, when l and k are 2 or more, $R^3$ and $R^4$ may be the same as or different from each other, and may form a ring.

8. The electrophotographic photoreceptor of claim 1, further comprising an intermediate layer between the conductive support and the photosensitive layer.

9. The electrophotographic photoreceptor of claim 8, wherein the intermediate layer contains rutile type titanium oxide and a polyamide, the rutile type titanium oxide is contained in an amount of from 30 to 50% by weight based on the total weight of the intermediate layer, and the intermediate layer, the charge generating layer and the charge transporting layer are laminated in this order on the conductive support.

10. An electrophotographic photoreceptor comprising a conductive support, and a photosensitive layer having a layered structure comprising a charge generating layer and a charge transporting layer, the photosensitive layer being formed on the conductive support, the charge generating layer comprising, as a charge generating substance, a crystalline titanyl phthalocyanine composition exhibiting a maximum diffraction intensity at a Bragg angle ($2\eta \pm 0.2°$) of 27.3° in an X-ray diffraction spectrum of a CuKα characteristic X-ray (wavelength: 1.5418 Å), the charge transporting layer comprising, as a charge transporting substance, a bisamine compound represented by a general formula (I):

(I)

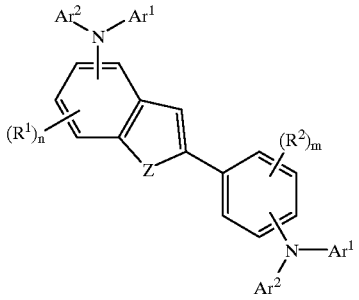

wherein $Ar^1$ and $Ar^2$ each represent an aryl group, which may have a substituent, a heterocyclic group, which may have a substituent, an aralkyl group, which may have a substituent, or an alkyl group substituted with a heterocyclic group, which may have a substituent; Z represents an atom of O, S or Se; $R^1$ and $R^2$ each represent an alkyl, alkoxy or dialkylamino group having from 1 to 3 carbon atoms, which may have a substituent, or a halogen atom or a hydrogen atom; m represents an integer of from 1 to 4; and n represents an integer of from 1 to 3, provided that when m and n are 2 or more, $R^1$ and $R^2$ may be the same as or different from each other, and may form a ring.

11. The electrophotographic photoreceptor of claim 10, wherein the crystalline titanyl phthalocyanine composition further exhibits, in the X-ray diffraction spectrum, plural diffraction peaks at Bragg angles of from 9.0 to 10.0°, and a diffraction peak at a Bragg angle of 24.0° that is broader than the diffraction peak at a Bragg angle of 27.3°.

12. The electrophotographic photoreceptor of claim 11, wherein the plural diffraction peaks present at Bragg angles of from 9.0 to 10.0° and the diffraction peak present at a Bragg angle of 24.0° have intensities of 25% or less of a diffraction intensity at a Bragg angle of 27.3°, and contain a diffraction peak indicating an amorphous pattern.

13. The electrophotographic photoreceptor of claim 11, wherein at least one of the plural diffraction peaks present at a Bragg angle of from 9.0 to 10.0° is present at a Bragg angle of 9.1°, 9.3° or 9.5°.

14. The electrophotographic photoreceptor of claim 10, wherein the charge generating layer further comprises a butyralated binder resin.

15. The electrophotographic photoreceptor of claim 10, wherein the charge transporting layer comprises, as a binder resin, a polycarbonate represented by a general formula (IV) selected to have a viscosity average molecular weight of from 35,000 to 85,000:

(IV)

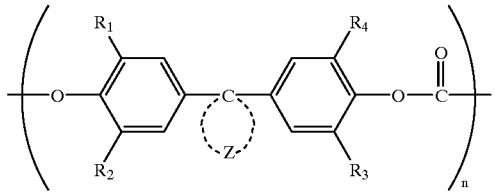

wherein R1 to R4 each represent a hydrogen atom, a halogen atom or an alkyl group having from 1 to 4 carbon atoms; and Z represents an atomic group for forming a substituted or unsubstituted carbon ring or a substituted or unsubstituted heterocycle.

16. The electrophotographic photoreceptor of claim 10, wherein the charge transporting layer contains, as an antioxidant, a hindered phenol.

17. The electrophotographic photoreceptor of claim 16, wherein the hindered phenol is contained in an amount of from 0.5 to 10% by weight based on the charge transporting substance.

* * * * *